US011776465B2

(12) United States Patent
Park et al.

(10) Patent No.: US 11,776,465 B2
(45) Date of Patent: Oct. 3, 2023

(54) DISPLAY MODULE AND DISPLAY APPARATUS INCLUDING THE SAME

(71) Applicant: SAMSUNG ELECTRONICS CO., LTD., Suwon-si (KR)

(72) Inventors: Sangyoung Park, Suwon-si (KR); Daisuke Kawae, Yokohama (JP); Junichi Yamashita, Yokohama (JP); Jongsu Oh, Suwon-si (KR); Hoseop Lee, Suwon-si (KR); Tetsuya Shigeta, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/831,972

(22) Filed: Jun. 3, 2022

(65) Prior Publication Data

US 2022/0301498 A1 Sep. 22, 2022

Related U.S. Application Data

(63) Continuation of application No. PCT/KR2021/017398, filed on Nov. 24, 2021.

(30) Foreign Application Priority Data

Nov. 25, 2020 (KR) ..... 10-2020-0160301

(51) Int. Cl.
*G09G 3/32* (2016.01)

(52) U.S. Cl.
CPC ..... *G09G 3/32* (2013.01); *G09G 2310/0275* (2013.01); *G09G 2310/08* (2013.01); *G09G 2320/0633* (2013.01)

(58) Field of Classification Search
CPC ..... G09G 3/32; G09G 2310/0275; G09G 2310/08; G09G 2320/0633; G09G 3/2014;
(Continued)

(56) References Cited

U.S. PATENT DOCUMENTS 7,522,131 B2 * 4/2009 Kang ..... G09G 3/22 345/74.1
7,609,234 B2 10/2009 Cho et al.
(Continued)

FOREIGN PATENT DOCUMENTS

JP 6-13659 A 1/1994
KR 10-0599497 B1 7/2006
(Continued)

OTHER PUBLICATIONS

International Search Report dated Mar. 15, 2022 issued by the International Searching Authority in International Application No. PCT/KR2021/017398 (PCT/ISA/210), English Translation.
(Continued)

*Primary Examiner* — Andrew Sasinowski
(74) *Attorney, Agent, or Firm* — Sughrue Mion, PLLC

(57) ABSTRACT

A display module is provided. The display module includes a module substrate; a plurality of pixels provided on an upper surface of the module substrate; and a plurality of micro pixel controllers, each of the plurality of micro pixel controllers being configured to control at least two pixels among the plurality of pixels and being provided in a space between the at least two pixels on the upper surface of the module substrate, wherein at least one of the plurality of micro pixel controllers includes a slope waveform generator configured to generate a slope waveform used to control a brightness of each of the at least two pixels.

20 Claims, 26 Drawing Sheets

$V_D > V_{slope} \rightarrow I_D$ ON

(58) Field of Classification Search
CPC ..... G09G 2300/026; G09G 3/3275; G09G 2300/0804; G09G 2310/0259; G09G 2340/02; G09G 3/006
See application file for complete search history.

(56) References Cited

U.S. PATENT DOCUMENTS

| | | | | |
|---|---|---|---|---|
| 8,643,683 | B2 | 2/2014 | Chang et al. | |
| 9,535,440 | B2 | 1/2017 | Seo et al. | |
| 10,650,737 | B2 | 5/2020 | Vahid Far et al. | |
| 10,832,615 | B2 | 11/2020 | Kim et al. | |
| 11,100,840 | B2 | 8/2021 | Kim et al. | |
| 11,100,849 | B1 * | 8/2021 | Yang | G09G 3/32 |
| 2018/0247586 | A1 | 8/2018 | Vahid Far et al. | |
| 2019/0371232 | A1 * | 12/2019 | Kim | H01L 25/0753 |
| 2021/0210003 | A1 * | 7/2021 | Kim | G09G 3/32 |

FOREIGN PATENT DOCUMENTS

| | | | |
|---|---|---|---|
| KR | 10-2019-0137658 | A | 12/2019 |
| KR | 10-2148498 | B1 | 8/2020 |
| KR | 10-2020-0114980 | A | 10/2020 |

OTHER PUBLICATIONS

International Written Opinion dated Mar. 15, 2022 issued by the International Searching Authority in International Application No. PCT/KR2021/017398 (PCT/ISA/237), No Translation.
Communication dated Mar. 24, 2023, issued by the European Patent Office in European Application No. 21 898 600.8.

* cited by examiner $V_D > V_{slope} \rightarrow I_D$ ON $V_D > V_{slope} \rightarrow I_D$ ON

DISPLAY MODULE AND DISPLAY APPARATUS INCLUDING THE SAME

CROSS-REFERENCE TO RELATED APPLICATION(S)

This application is a by-pass continuation of International Application No. PCT/KR2021/017398, filed on Nov. 24, 2021, in the Korean Intellectual Property Receiving Office and claiming priority to Korean Patent Application No. 10-2020-0160301, filed on Nov. 25, 2020, in the Korean Intellectual Property Office, the disclosures of which are incorporated by reference herein in their entireties.

BACKGROUND

1. Field

The disclosure relates to a display module capable of implementing an image using an inorganic light-emitting element and a display apparatus including the same.

2. Description of Related Art

A display apparatus may include an emissive display in which each pixel emits light by itself and a non-emissive display that requires a separate light source.

A liquid crystal display (LCD) is a typical non-emissive display, and needs a backlight unit configured to supply light from the rear of a display panel, a liquid crystal layer configured to serve as a switch to transmit/block light, a color filter configured to change supplied light to a desired color, and the like. Thus, the LCD is complex in structure and has a limitation in realizing a small thickness.

On the other hand, in the emissive display in which each pixel emits light by itself by including a light-emitting element for each pixel, components such as a backlight unit and a liquid crystal layer are not required and a color filter can also be omitted. Thus, the emissive display is structurally simple and can have a high degree of freedom in design. In addition, the emissive display may realize not only a small thickness, but also an excellent contrast ratio, brightness, and viewing angle.

Among emissive displays, a micro light-emitting diode (LED) display is one of flat panel displays and includes a plurality of LEDs each having a size in micrometers. In comparison with the LCD that requires a backlight, the micro-LED display may provide better contrast, response time, and energy efficiency.

Further, the micro-LED, which is an inorganic light-emitting element, has higher brightness, better light emission efficiency, and a longer lifespan in comparison with an organic light-emitting diode (OLED), which requires a separate encapsulation layer for protecting organic materials.

SUMMARY

Provided are a display module and a display apparatus including the same, allowing circuit inspection and replacement to be easily performed and a manufacturing process of the display module or the display apparatus having the same to be further facilitated by providing a thin-film transistor circuit for driving an inorganic light-emitting element on a separate chip.

According to an aspect of the disclosure, there is provided a display module including: a module substrate; a plurality of pixels provided on an upper surface of the module substrate; and a plurality of micro pixel controllers, each of the plurality of micro pixel controllers being configured to control at least two pixels among the plurality of pixels and being provided in a space between the at least two pixels on the upper surface of the module substrate, wherein at least one of the plurality of micro pixel controllers includes a slope waveform generator configured to generate a slope waveform used to control a brightness of each of the at least two pixels.

Each of the plurality of micro pixel controllers may include at least two pixel circuits configured to output driving currents to be applied to the at least two pixels, and the slope waveform generated by the slope waveform generator may be input to each of the at least two pixel circuits.

Each of the at least two pixel circuits may include: a pulse amplitude modulation (PAM) control circuit configured to control an amplitude of a driving current applied to one of the at least two pixels; and a pulse width modulation (PWM) control circuit configured to control a pulse width of the driving current based on the input slope waveform.

A slope voltage output from the slope waveform generator may be input to the PWM control circuit.

The display module may further include a driver integrated circuit (IC) electrically connected to the module substrate and configured to transmit at least one of a data signal and a gate signal to the plurality of micro pixel controllers.

The driver IC may receive image data and a timing control signal output from a timing controller.

The driver IC may include a data driver IC configured to generate the data signal, and at least one of the plurality of micro pixel controllers may be configured to generate the gate signal.

According to an aspect of the disclosure, a display apparatus includes: a housing; and a plurality of display modules mounted in the housing, wherein each of the plurality of display modules includes a module substrate, a plurality of pixels arranged provided on an upper surface of the module substrate, and a plurality of micro pixel controllers, each of the plurality of micro pixel controllers being configured to control at least two pixels among the plurality of pixels and being provided in a space between the at least two pixels on the upper surface of the module substrate, wherein at least one of the plurality of micro pixel controllers includes a slope waveform generator configured to generate a slope waveform used to control a brightness of the at least two pixels.

Each of the plurality of micro pixel controllers may include at least two pixel circuits configured to output driving currents to be applied to the at least two pixels, and the slope waveform generated by the slope waveform generator may be input to each of the at least two pixel circuits.

Each of the at least two pixel circuits may include: a pulse amplitude modulation (PAM) control circuit configured to control an amplitude of a driving current applied to one of the at least two pixels; and a pulse width modulation (PWM) control circuit configured to control a pulse width of the driving current based on the input slope waveform.

A slope voltage output from the slope waveform generator may be input to the PWM control circuit.

The display apparatus may further include a driver integrated circuit (IC) electrically connected to the module substrate and configured to transmit at least one of a data signal and a gate signal to the plurality of micro pixel controllers.

The display apparatus may further include a timing controller configured to transmit image data and a timing control signal to the driver IC.

The driver IC may include a data driver IC configured to generate the data signal, and at least one of the plurality of micro pixel controllers may be configured to generate the gate signal.

According to an aspect of the disclosure, a display apparatus includes: a plurality of display modules; and a timing controller configured to transmit image data and a timing control signal to the plurality of display modules, wherein each of the plurality of display modules includes: a module substrate, a plurality of inorganic light-emitting elements provided on an upper surface of the module substrate, and a plurality of micro pixel controllers, each of the plurality of micro pixel controllers being configured to control an amplitude and a pulse width of a driving current applied to at least two inorganic light-emitting elements among the plurality of inorganic light-emitting elements and being provided in a space between the at least two inorganic light-emitting elements, wherein at least one of the plurality of micro pixel controllers includes a slope waveform generator configured to generate a slope waveform used to control the pulse width of the driving current.

A display module and a display apparatus including the same according to an aspect of the disclosure, a thin-film transistor circuit for driving an inorganic light-emitting element may be provided on a separate chip such that circuit inspection and replacement are easily performed and a manufacturing process of the display module or the display apparatus having the same can be further facilitated.

DETAILED DESCRIPTION

Figure 1:
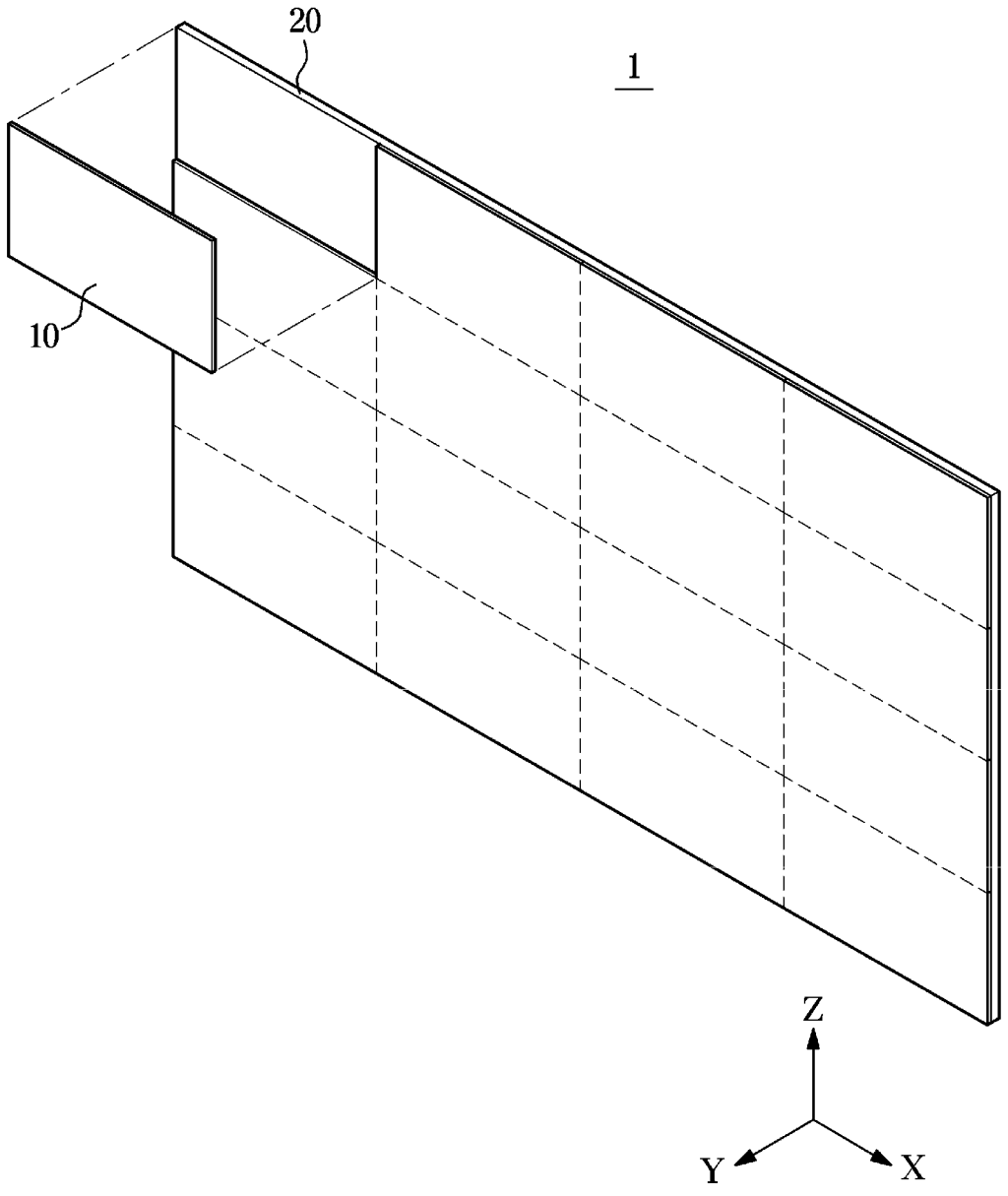
FIG. 1 is a perspective view illustrating an example of a display module and a display apparatus including the same according to an embodiment.

The same reference numerals may refer to the same components throughout the specification. The present specification does not describe all elements of an embodiment, and common descriptions in the technical field to which the present invention pertains or redundant descriptions between the embodiments will be omitted. Terms such as "unit," "module," "member," and "block" used herein may be implemented as software or hardware, and according to the embodiment, a plurality of "units," "modules," "members," and "blocks" may be implemented as a single component or a single "unit," "module," "member," or "block" may include a plurality of components.

Throughout the specification, when a part is referred to as being "connected to" another part, the part may be directly or indirectly connected to the another part, and the indirect connection includes connection via a wireless communication network or electrical connection by line, soldering, or the like.

Further, when a part is referred to as "including" or "comprising" a component, unless there is a particular description contrary thereto, the part may further include another component, not excluding another component.

Throughout the specification, when a member is referred to as being located "on" another member, this includes not only when the member is in contact with another member, but also when still another member is present between the member and another member.

Throughout the specification, when a component transfers or transmits a signal or data to another component, it is noted that there is still another component between the corresponding component and another component and the signal or data is transferred or transmitted through the still another component, unless there is a particular description contrary thereto.

Throughout the specification, the expression of ordinal numbers such as "first," and "second," is used to distinguish a plurality of components from each other, but the ordinal numbers used are not intended to indicate an arrangement order, a manufacturing order, a degree of importance, or the like between the components.

Singular expressions include plural expressions unless otherwise clarified in the context.

A reference numeral attached in each of operations is used to refer to each of the operations, and this reference numeral is not intended to limit the order of the operations, and the operations may be differently performed from the described order unless clearly specified in the context.

Hereinafter, an embodiment of a display module and a display apparatus having the same according to an aspect will be described in detail with reference to the accompanying drawings.

Figure 2:
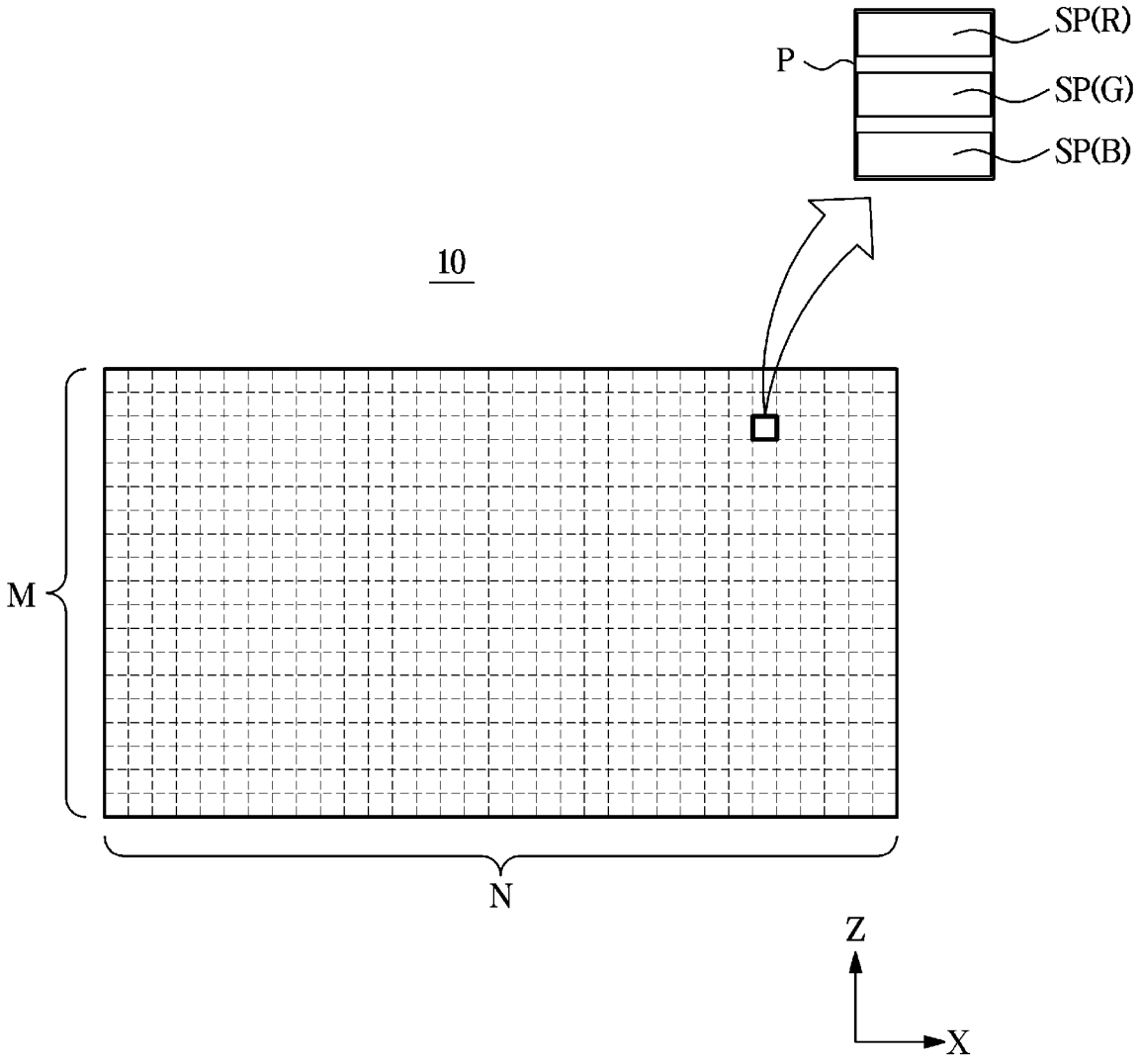
FIG. 2 is a view illustrating an example of an arrangement of pixels constituting a unit module of the display apparatus according to an embodiment.

FIG. 1 is a diagram illustrating an example of a display module and a display apparatus having the same according to an embodiment, and FIG. 2 is a diagram illustrating an example of an arrangement of pixels constituting a unit module of the display apparatus according to an embodiment.

A display apparatus according to one embodiment may refer to a self-emitting display apparatus in which a light-emitting element is disposed for each pixel so that each pixel may emit light by itself. Accordingly, unlike a liquid crystal display (LCD) apparatus, since a component such as a backlight unit, a liquid crystal layer, or the like is not required, it is possible to realize a small thickness, and various design changes are possible due to the simple structure.

Further, the display apparatus according to an embodiment may employ an inorganic light-emitting element, such as an inorganic light-emitting diode (LED), as the light-emitting element disposed in each pixel. The inorganic light-emitting element has a faster response speed than an organic light-emitting element, such as an organic light-emitting diode (OLED), and may realize high luminance with low power.

In addition, in comparison with the organic light-emitting element that requires an encapsulation process because the organic light-emitting element is vulnerable to exposure to moisture and oxygen and has poor durability, the inorganic light-emitting element does not require the encapsulation process and has better durability. Hereinafter, the inorganic light-emitting element mentioned in the embodiment to be described below means an inorganic LED.

The inorganic light-emitting element employed in the display apparatus according to one embodiment may be a micro-LED having a short side length of about 100 μm and a size of several tens of μm or several μm. As described above, by employing the micro-scale LED, a pixel size may be reduced and a higher resolution may be realized within the same size screen.

In addition, when an LED chip is manufactured in the size of a micro unit, it is possible to solve a problem in which the LED chip is broken due to characteristics of inorganic materials upon being bent. That is, when the micro-LED chip is transferred to a flexible substrate, the LED chip is not broken even when the substrate is bent, so that a flexible display apparatus may also be implemented.

A display apparatus employing a micro-LED may be applied to various fields by using a very small pixel size and a thin thickness. As an example, as shown in FIG. 1, by tiling a plurality of display modules 10, to each of which a plurality of micro-LEDs are transferred, and by fixing the plurality of display modules 10 to a housing 20, it is possible to implement a large-area screen, and a display apparatus 1 of the large-area screen may be used as a signage, an electric billboard, or the like.

A three-dimensional coordinate system of XYZ axes shown in FIG. 1 is based on the display apparatus 1, a plane on which a screen of the display apparatus 1 is located is an XZ plane, and a direction in which an image is output or an inorganic light-emitting element emits light is a +Y direction. Since the coordinate system is based on the display apparatus 1, the same coordinate system may be applied to both cases in which the display apparatus 1 is in a downward state (e.g., lying down) and the display apparatus 1 is upright.

In general, the display apparatus 1 may be used in an upright state, and a user views an image in the front of the display apparatus 1, such that the +Y direction in which the image is output is referred to as a front side, and a direction opposite to the front side may be referred to as a rear side.

Further, the display apparatus 1 may be generally manufactured in a downward state. Accordingly, a −Y direction of the display apparatus 1 may be referred to as a downward direction, and the +Y direction may be referred to as an upward direction. That is, in the embodiment described below, the +Y direction may be referred to as the upward direction or may also be referred to as the front side, and the −Y direction may be referred to as the downward direction or may also be referred to as the rear side.

The other four surfaces except for an upper surface and a lower surface of the flat-panel-type display apparatus 1 or display module 10 are referred to as side surfaces regardless of a posture of the display apparatus 1 or the display module 10.

In the example of FIG. 1, the display apparatus 1 is illustrated as implementing a large-area screen by including the plurality of display modules, but the embodiment of the display apparatus 1 is not limited thereto. The display apparatus 1 may also be implemented as a television (TV), a wearable device, a portable device, a monitor for a personal computer (PC), and the like by including a single display module.

Referring to FIG. 2, the display module 10 may include pixels in an M×N (M and N are integers of 2 or more) array, that is, a plurality of pixels arranged two dimensionally. FIG. 2 conceptually illustrates a pixel arrangement, and thus, in the display module 10, in addition to an active region in which pixels are arranged, a bezel region or a line region in which an image is not displayed may also be located.

In this embodiment, when it is described that certain components are arranged two dimensionally, this may include a case in which the corresponding components are arranged on the same plane as well as a case in which the corresponding components are arranged on different planes parallel to each other. In addition, in the case in which the corresponding components are disposed on the same plane, upper ends of the arranged components do not necessarily have to be located on the same plane, and the upper ends of the arranged components may be located on different planes that are parallel to each other.

Referring to FIG. 2, a pixel P may include a plurality of sub-pixels that output light of different colors in order to implement various colors by a color combination. For example, the pixel P may include at least three sub-pixels outputting light of different colors. The pixel P may include three sub-pixels SP(R), SP(G), and SP(B), which respectively correspond to red (R), green (G), and blue (B). Here, a red sub-pixel SP(R) may output red light, a green sub-pixel SP(G) may output green light, and a blue sub-pixel SP(B) may output blue light.

However, the pixel arrangement of FIG. 2 is merely an example that may be applied to the display module 10 and the display apparatus 1 according to one embodiment, and the sub-pixels may be arranged along an X-axis direction, may not be arranged in a line, and may be implemented to have different sizes. In order to implement various colors, a single pixel only needs to include a plurality of sub-pixels, and there is no limitation on a size of each sub-pixel or an arrangement method of the sub-pixels.

Further, the pixel P does not necessarily include the red sub-pixel SP(R) configured to output red light, the green sub-pixel SP(G) configured to output green light, and the blue sub-pixel SP(B) configured to output blue light, and may include a sub-pixel configured to output yellow light or white light. That is, there is no limitation on the color or type of light output from each sub-pixel and the number of sub-pixels.

However, in the embodiment to be described below, for detailed description, the case in which the pixel P includes the red sub-pixel SP(R), the green sub-pixel SP(G), and the blue sub-pixel SP(B) will be described as an example.

As described above, each of the display module 10 and the display apparatus 1 according to one embodiment is a self-emitting display apparatus in which each pixel may emit light by itself. Accordingly, an inorganic light-emitting element that emits light of different colors may be disposed in each sub-pixel. For example, a red inorganic light-emitting element may be disposed in the red sub-pixel SP(R), a green inorganic light-emitting element may be disposed in the green sub-pixel SP(G), and a blue inorganic light-emitting element may be disposed in the blue sub-pixel SP(B).

Accordingly, in this embodiment, the pixel P may represent a cluster including the red inorganic light-emitting element, the green inorganic light-emitting element, and the blue inorganic light-emitting element, and the sub-pixel may represent each inorganic light-emitting element.

Figure 3:
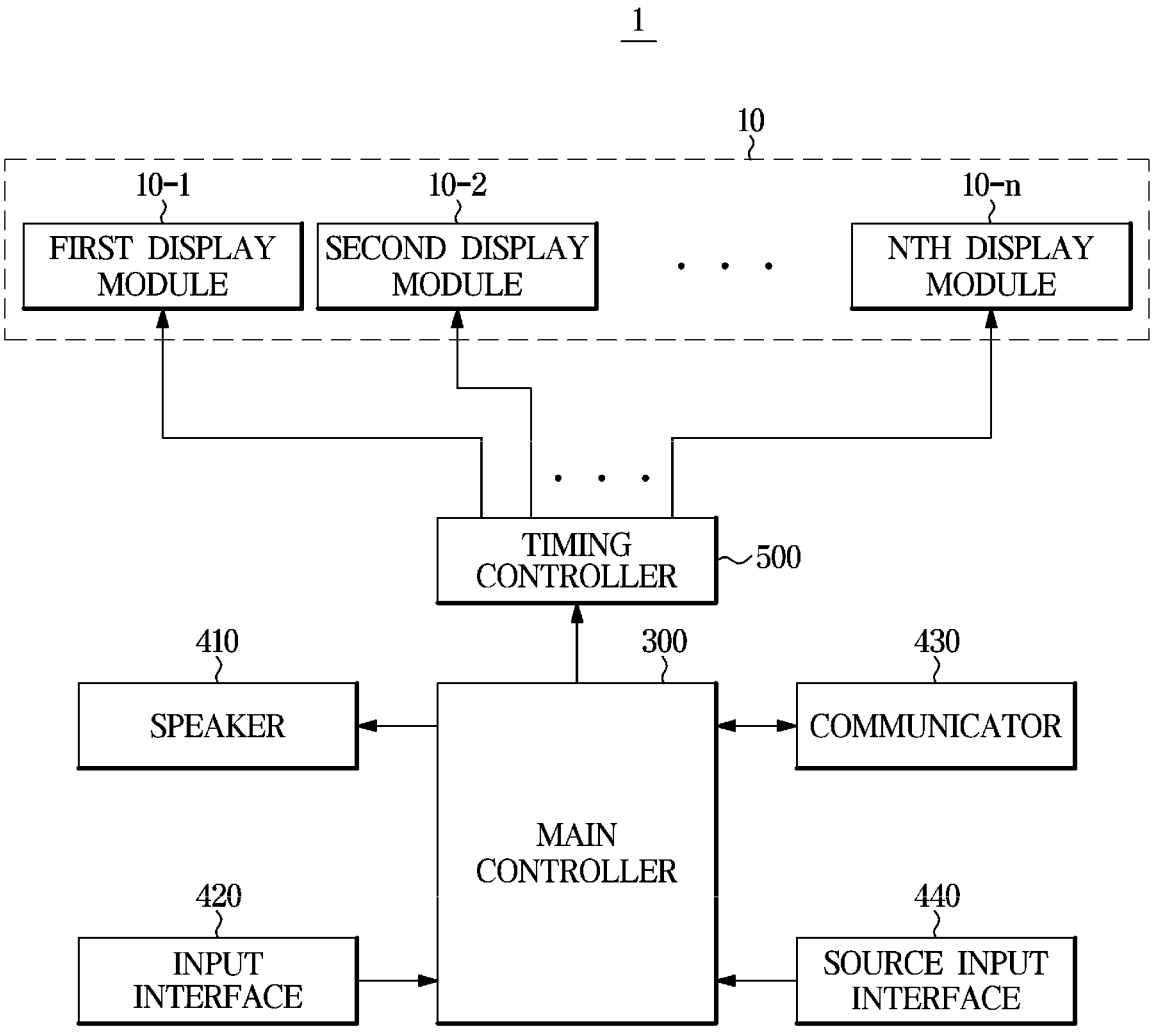
FIGS. 3 and 4 are control block diagrams of the display apparatus according to an embodiment.
Figure 4:
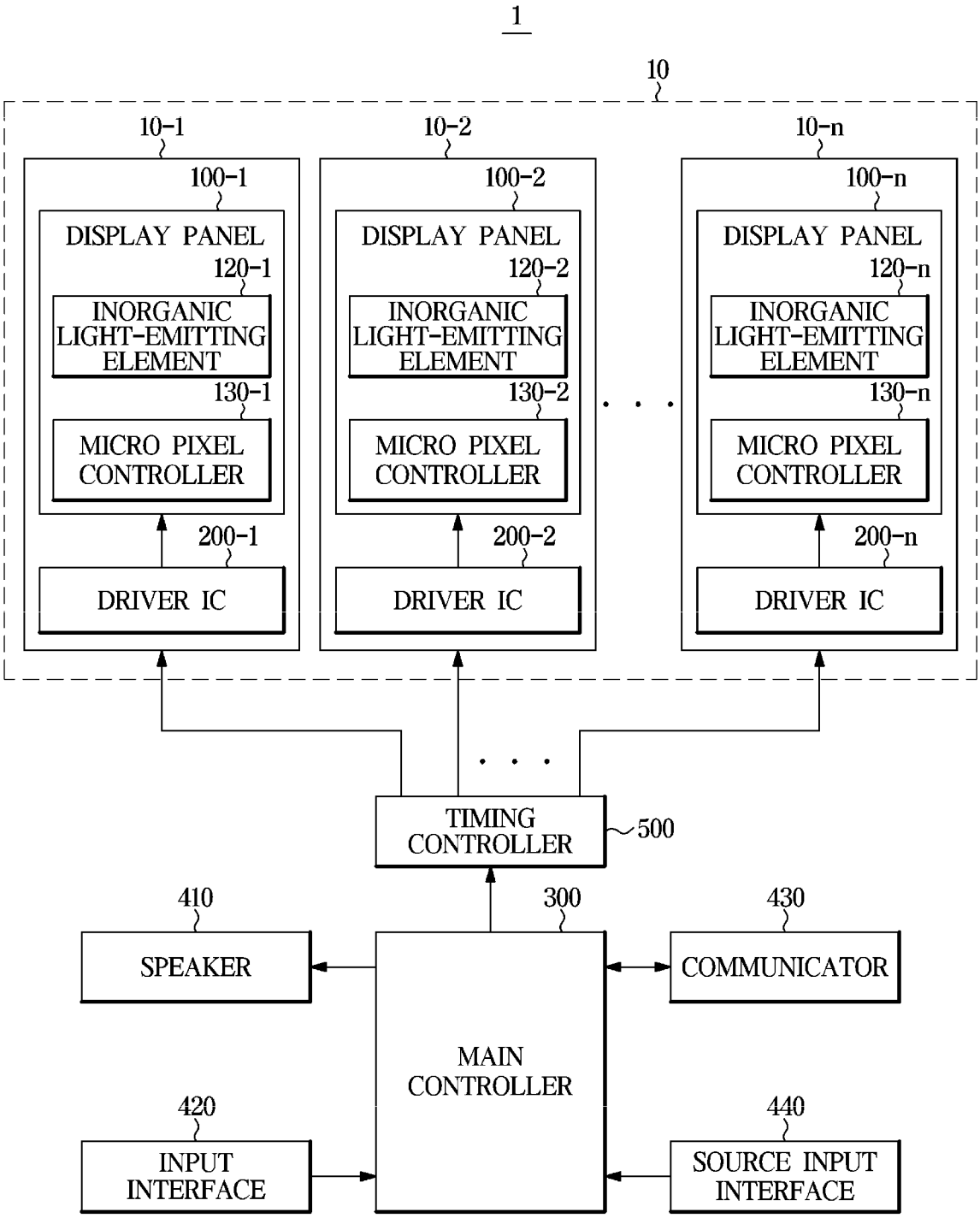

FIGS. 3 and 4 are control block diagrams of the display apparatus according to an embodiment.

Referring to FIG. 3, the display apparatus 1 according to an embodiment may include a plurality of display modules 10-1, 10-2, . . . , and **10-*n* (where n is an integer greater than or equal to two) and may include a main controller 300 and a timing controller 500, which are configured to control the plurality of display modules 10, a communicator 430 configured to communicate with an external device, a source input interface 440 configured to receive a source image, a speaker 410 configured to output sound, and an input interface 420 configured to receive a command for controlling the display apparatus 1** from a user.

The input interface 420 may include a button or a touch pad provided in one region of the display apparatus 1, and when a display panel (FIG. 4) is implemented as a touch screen, the input interface 420 may include a touch pad provided on a front surface of the display panel 100. In addition, the input interface 420 may also include a remote controller.

The input interface 420 may receive various commands for controlling the display apparatus 1, such as power on/off, volume adjustment, channel adjustment, screen adjustment, various setting changes, or the like of the display apparatus 1, from the user.

The speaker 410 may be provided in one region of the housing 20, and a separate speaker module physically separated from the housing 20 may be further provided.

The communicator 430 may transmit and receive necessary data by performing communication with a relay server or other electronic devices. The communicator 430 may employ at least one of various wireless communication methods, such as 3rd Generation (3G), 4th Generation (4G), wireless LAN, Wi-Fi, Bluetooth, Zigbee, Wi-Fi Direct (WFD), ultra-wide band (UWB), infrared data association (IrDA), Bluetooth low energy (BLE), near field communication (NFC), and Z-wave. The communicator 430 may also employ a wired communication method such as peripheral component interconnect (PCI), PCI-express, or universal serial bus (USB).

The source input interface 440 may receive a source signal input from a set-top box, a USB, an antenna, and the like. Accordingly, the source input interface 440 may include at least one selected from a source input interface group including a high definition multimedia interface (HDMI) cable port, a USB port, an antenna, and the like.

The source signal received by the source input interface 440 may be processed by the main controller 300 to be converted into a form that may be output by the display panel 100 and the speaker 410.

The main controller 300 and the timing controller 500 may include at least one memory, which is configured to store programs for performing operations to be described below and various types of data, and at least one processor configured to execute the stored programs.

The main controller 300 may process the source signal input through the source input interface 440 to generate an image signal corresponding to the input source signal.

For example, the main controller 300 may include a source decoder, a scaler, an image enhancer, and a graphics processor. The source decoder may decode a source signal compressed in a format such as a Motion Picture Experts Group (MPEG) format, and the scaler may output image data of a desired resolution through resolution conversion.

The image enhancer may improve the image quality of the image data by applying various correction techniques. The graphics processor may classify pixels of the image data into RGB data and output a control signal such as a syncing signal for display timing in the display panel. That is, the main controller 300 may output image data, which corresponds to the source signal, and a control signal.

The above-described operation of the main controller 300 is merely an example applicable to the display apparatus 1, and the main controller 300 may further perform other operations, or some of the operations described above may be omitted.

The image data and the control signal output from the main controller 300 may be transmitted to the timing controller 500.

The timing controller 500 may convert the image data transmitted from the main controller 300 into image data of a format that may be processed in a driver integrated circuit (IC) 200 (FIG. 4), and generate various control signals such as a timing control signal necessary for displaying the image data on the display panel.

The display apparatus 1 according to one embodiment does not need to include the plurality of display modules 10, but in the embodiment to be described below, for detailed description, an operation of each component will be described in detail by taking the display apparatus 1 including the plurality of display modules 10 as an example.

Referring to FIG. 4, each of the plurality of display modules 10-1, 10-2, and **10-*n* may include a respective display panel 100-1, 100-2, . . . , and 100-*n*, configured to display an image and a respective driver IC 200-1, 200-2, . . . , and 200-*n*, configured to drive the display panels 100-1, 100-2, . . . , and 100-*n***, respectively.

The display panels 100-1, 100-2, . . . , and **100-*n*** may include a plurality of pixels arranged two dimensionally as described above, and each of the pixels may include a plurality of sub-pixels to implement various colors.

Further, as described above, the display apparatus 1 according to an embodiment is a self-emitting display apparatus in which each pixel may emit light by itself. Accordingly, an inorganic light-emitting element 120-1, 120-2, . . . , and **120-*n*** may be disposed in each sub-pixel. That is, each of the plurality of pixels may include two or more inorganic light-emitting elements.

Each of the inorganic light-emitting elements 120-1, 120-2, . . . , and **120-*n* may be driven by an active matrix (AM) method or a passive matrix (PM) method, but in the embodiment to be described below, for detailed description, a case in which the inorganic light-emitting elements 120-1, 120-2, . . . , and 120-*n*** are driven by the AM method will be described as an example.

In the display module 10 according to an embodiment, each inorganic light-emitting element 120-1, 120-2, . . . , and **120-*n* may be individually controlled by a micro pixel controller 130-1, 130-2, . . . , and 130-*n*, respectively, and the micro pixel controllers 130-1, 130-2, . . . , and 130-*n* may operate in response to a driving signal output from the respective driver IC 200-1, 200-2, . . . , and 200-*n*, or the timing control signal output from the timing controller 500**.

Figure 5:
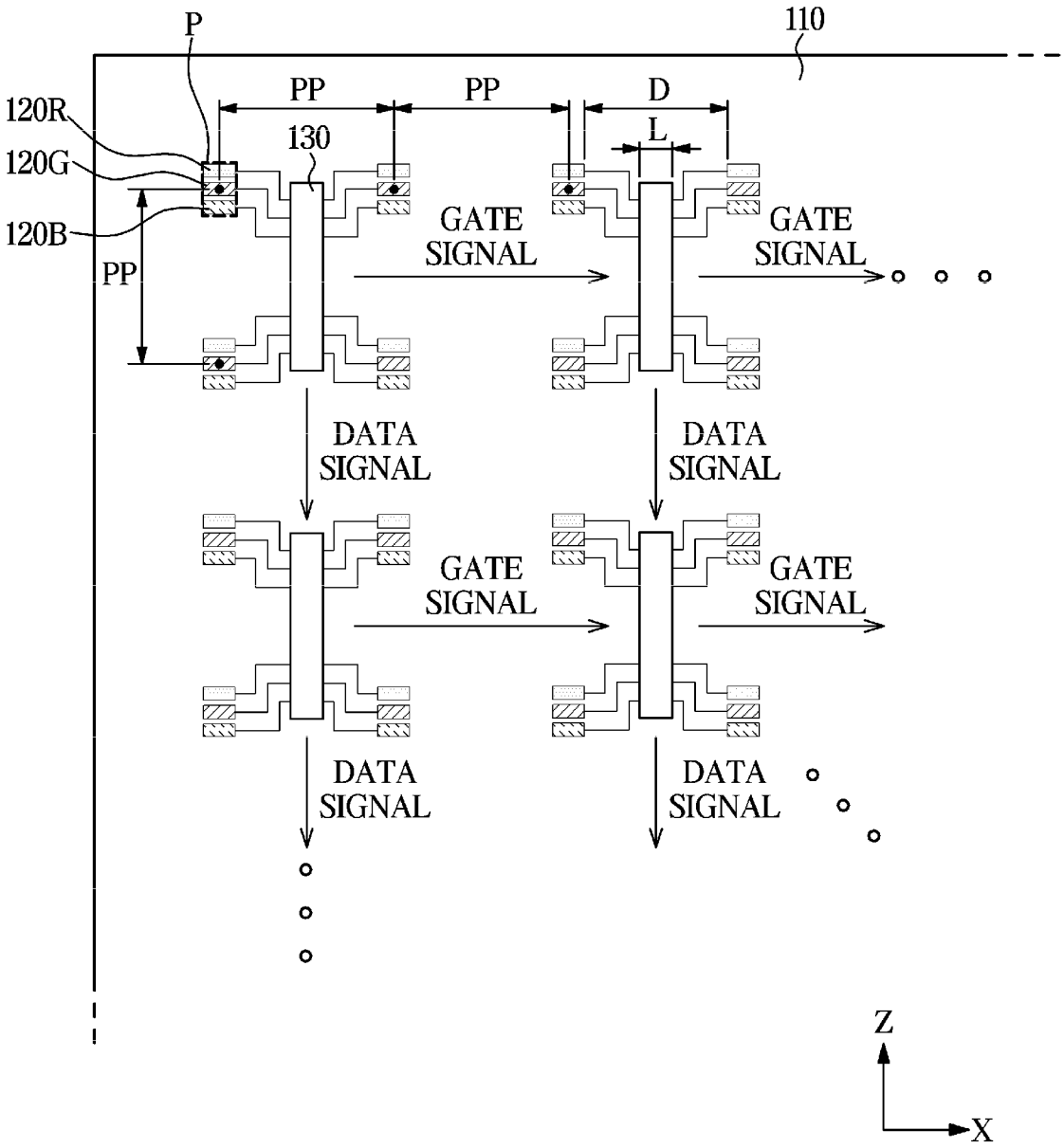
FIGS. 5 and 6 are diagrams illustrating an example of an arrangement of micro pixel controllers in the display module according to an embodiment.
Figure 6:
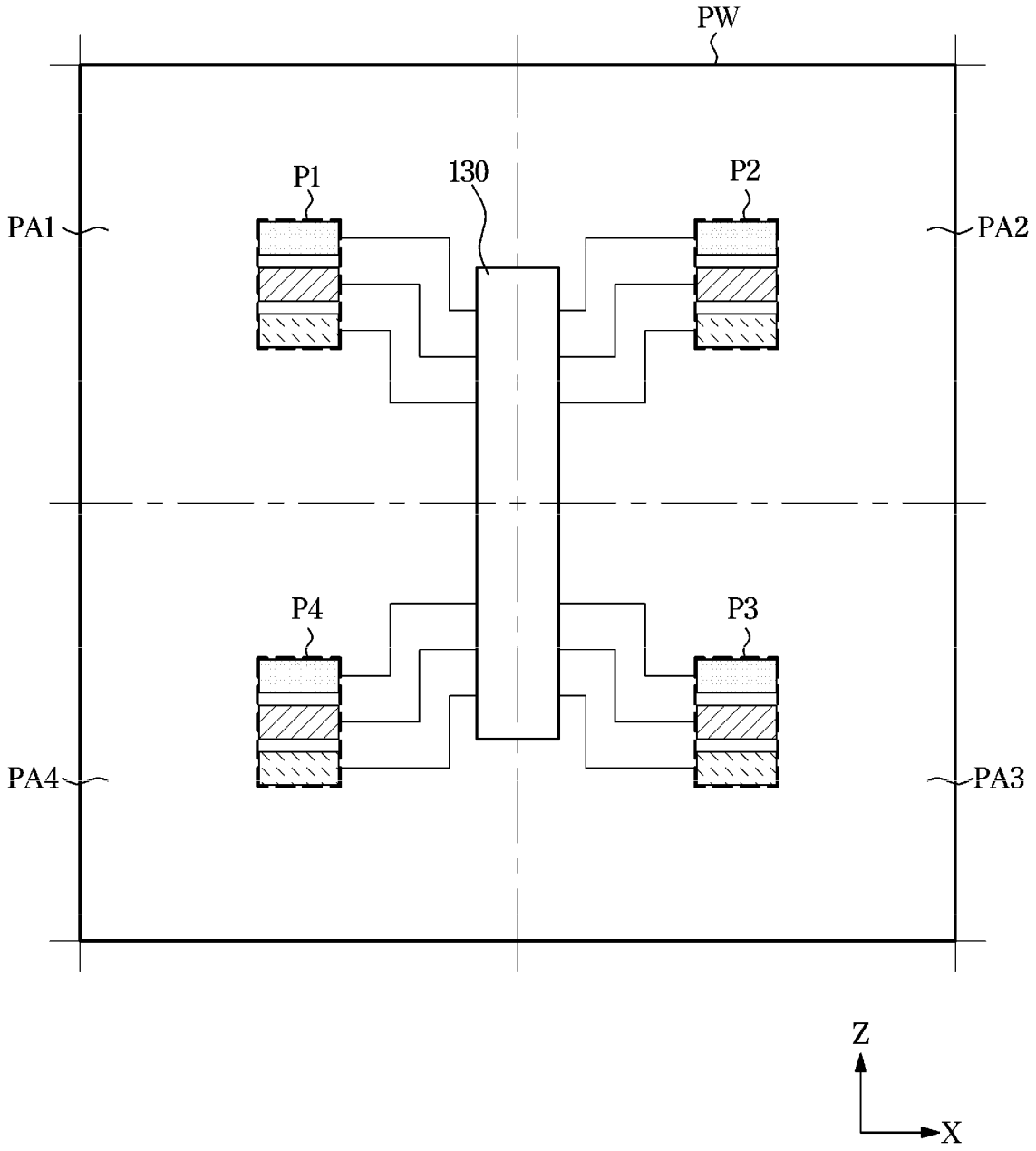

FIGS. 5 and 6 illustrate an example of an arrangement of the micro pixel controllers in the display module according to an embodiment.

Referring to FIG. 5, a plurality of pixels P are arranged two dimensionally on an upper surface of a module substrate 110, and the micro pixel controller 130 may be disposed in a space of the upper surface of the module substrate 110, in which the pixels P are not disposed.

When the plurality of pixels P are arranged on the module substrate 110, pixel intervals PP between adjacent pixels located on upper, lower, left, and right sides may all be identically maintained. In this embodiment, when it is described that certain values are identical, this may include not only a case in which the corresponding values are completely identical but also a case in which the corresponding values are identical within a predetermined error range.

The pixel interval PP may be referred to as a pixel pitch, and in this embodiment, the pixel interval PP is defined as representing a distance from a center of one pixel to a center of an adjacent pixel. However, since the embodiment of the display module 10 is not limited thereto, other definitions may be applied to the pixel interval PP.

One micro pixel controller 130 may control two or more pixels P, and the micro pixel controller 130 may be disposed in a space between the two or more pixels P. In the example of FIG. 5, a case in which one micro pixel controller 130 controls four pixels P is illustrated, but the embodiment of the display module 10 is not limited thereto, and there is no limitation on the number of the pixels P controlled by the micro pixel controller 130.

For example, when the micro pixel controller 130 has a rectangular parallelepiped shape, a length L of a short side of an upper or lower surface of the micro pixel controller 130 may be provided with a very small size that is less than a distance D between boundary lines of the adjacent pixels P, and the short side of the micro pixel controller 130 may be disposed parallel to a perpendicular line indicating the shortest distance between two adjacent pixels P. Here, the distance D between the boundary lines of the adjacent pixels P may refer to a distance between the inorganic light-emitting elements 120R, 120G and 120B included in different pixels P among the inorganic light-emitting elements 120 adjacent to each other.

That is, the micro pixel controller 130 may be disposed without affecting the intervals between the plurality of pixels P. Accordingly, even when the micro pixel controller 130 is disposed between the pixels P, the distance between the pixels P may be minimized so that a higher resolution may be realized within the same area.

On the other hand, when one micro pixel controller 130 controls the pixels P of an m×2 array (where m is an integer greater than or equal to one), as shown in FIG. 6, the micro pixel controller 130 may be disposed between two columns in which the pixels P to be controlled (hereinafter, used interchangeably with "control target pixel") are disposed.

Alternatively, when one micro pixel controller 130 controls the pixels P of a 2×n array (where n is an integer greater than or equal to one), it is also possible that the micro pixel controller 130 is disposed between two rows in which the pixels P to be controlled are disposed.

FIG. 6 is an enlarged view of an arrangement of the micro pixel controller, which is configured to control the pixels of a 2×2 array, and the pixels to be controlled.

Referring to FIG. 6, the micro pixel controller 130 may be disposed in at least one of pixel regions PA1, PA2, PA3, and PA4 of four pixels P1, P2, P3, and P4 that are controlled by the micro pixel controller 130. In this embodiment, the pixel region is a region in which each pixel is located, and when an active region of the display panel 100 is partitioned into arrays (M×N) equal to arrays of the pixels, a region including each pixel may be defined as a pixel region of the corresponding pixel.

The micro pixel controller 130 may be disposed in one of the pixel regions PA1, PA2, PA3, and PA4 of the pixels controlled by the micro pixel controller 130, may be disposed over two regions of the pixel regions PA1, PA2, PA3, and PA4, may be disposed over three regions of the pixel regions PA1, PA2, PA3, and PA4, or may be disposed over four regions of the pixel regions PA1, PA2, PA3, and PA4 as shown in FIG. 6.

Alternatively, the micro pixel controller 130 may be disposed at a center of one region in which the pixel regions PA1, PA2, PA3, and PA4 of four pixels P1, P2, P3, and P4 controlled by the micro pixel controller 130 are combined (i.e., at a center of an entire pixel region PW).

When the micro pixel controller 130 is disposed as described above, a driving current may be efficiently supplied to the plurality of pixels P controlled by the micro pixel controller 130. A detailed configuration for supplying the driving current to the control target pixels P will be described below.

The micro pixel controller 130 may be electrically connected to the control target pixels to control the plurality of pixels P. In this embodiment, when it is described that two components are electrically connected, this may include not only a case in which the two components are connected through lines, but also a case in which, between the two components, conductive materials through which electricity flows are directly soldered or a case in which a conductive adhesive is used. There is no restriction on a specific connection method as long as current flows between two connected components.

For example, when the soldering is performed on two components, gold-indium (Au—In) bonding, gold-tin (Au—Sn) bonding, copper (Cu) pillar/tin-silver (SnAg) bump bonding, and nickel (Ni) pillar/SnAg bump bonding, solder ball bonding using tin-silver-copper (SnAgCu), tin-bismuth (SnBi), or SnAg, and the like may be used.

In addition, when the conductive adhesive is used, a conductive adhesive, such as an anisotropic conductive film (ACF) and an anisotropic conductive paste (ACP), may be disposed between the two components and pressure is applied to allow current to flow in a direction in which the pressure is applied.

Figure 7:
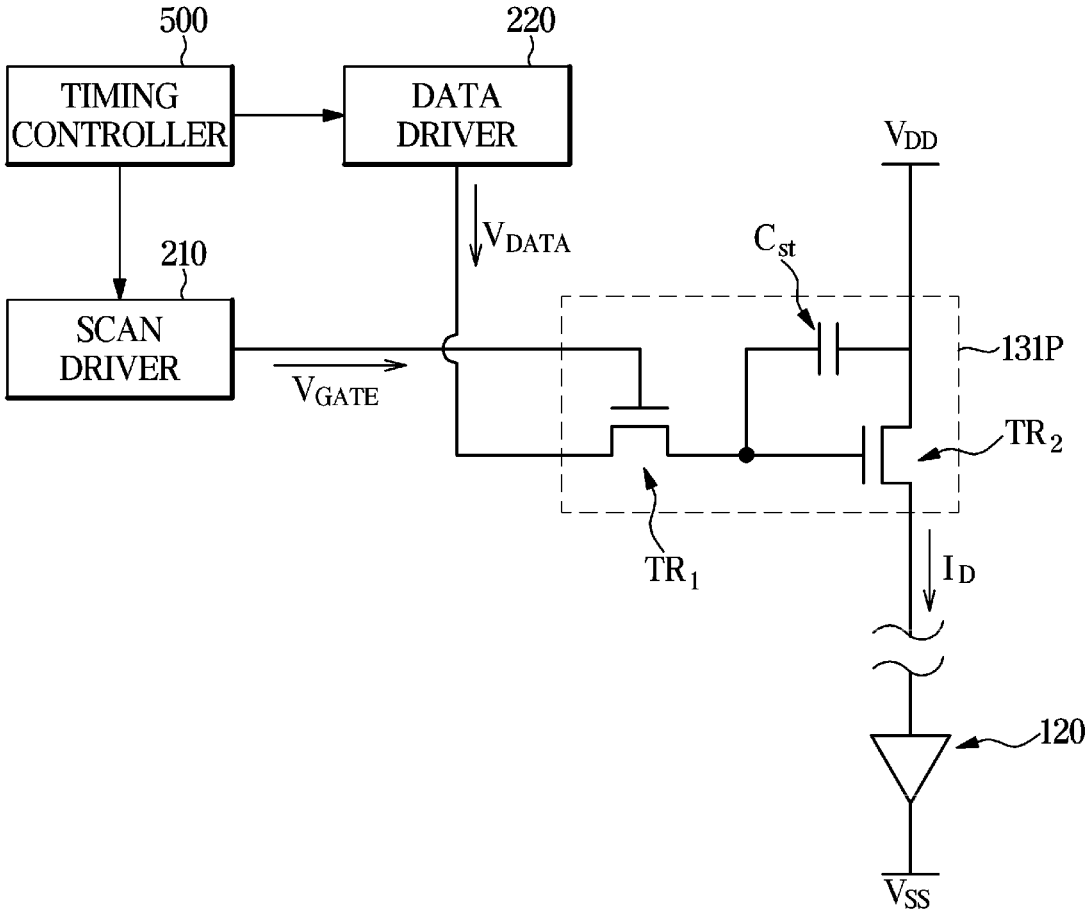
FIGS. 7 and 8 are diagrams illustrating a basic circuit structure necessary for the micro pixel controller to supply a driving current to a pixel in the display module according to an embodiment.
Figure 8:
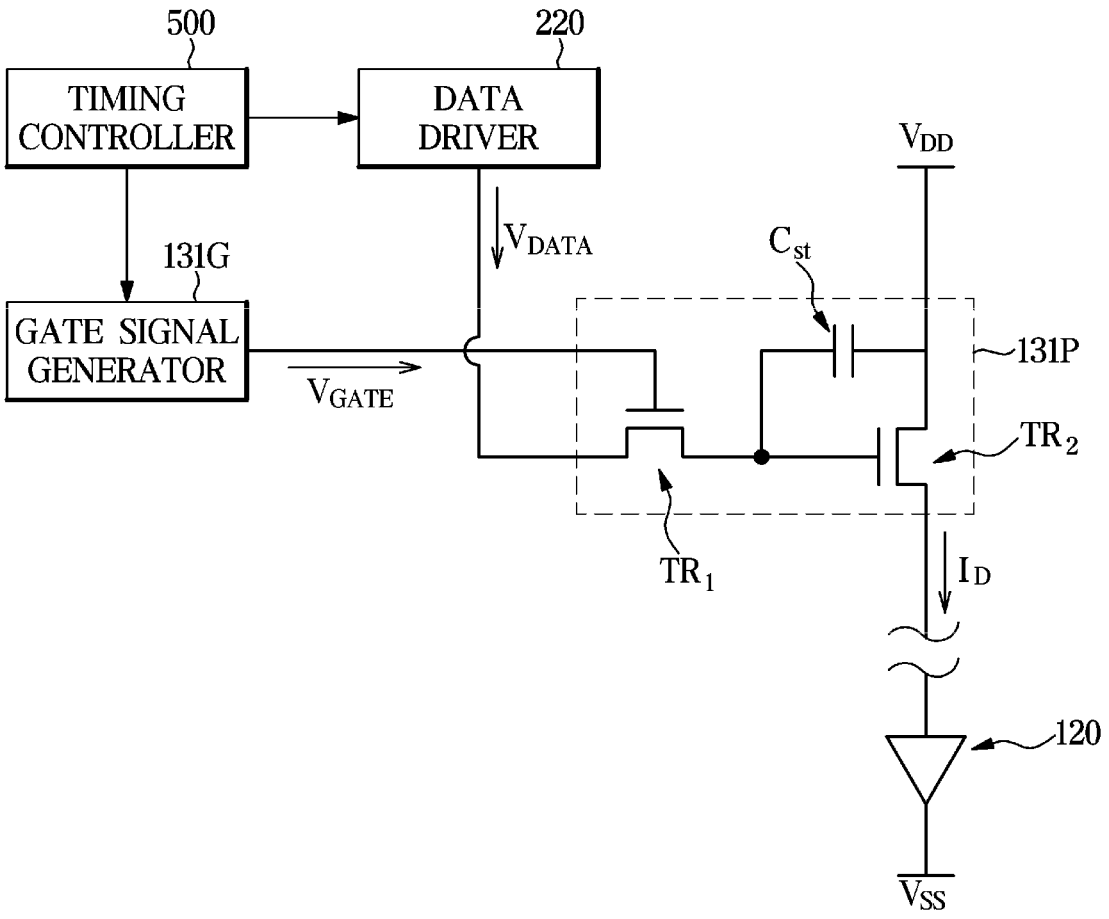

FIGS. 7 and 8 are diagrams illustrating a basic circuit structure necessary for the micro pixel controller to supply the driving current to the pixel in the display module according to an embodiment.

Referring to FIG. 7, the driver IC 200 may include a scan driver 210 and a data driver 220. The scan driver 210 may output a gate signal for turning the sub-pixel on/off, and the data driver 220 may output a data signal for implementing an image.

The scan driver 210 may generate the gate signal based on the timing control signal transmitted from the timing controller 500, and the data driver 220 may generate the data signal based on the image data transmitted from the timing controller 500. The gate signal may have a gate voltage for turning the sub-pixel on, and the data signal may have a data voltage that expresses a grayscale of the image.

However, according to various embodiments, some of the operations of the driver IC 200 may be performed by the micro pixel controller 130. For example, the operation of the scan driver 210 may be performed by the micro pixel controller 130, and in this case, as shown in FIG. 8, a gate signal generator 131G may be included in the micro pixel controller 130. When the gate signal is generated by the micro pixel controller 130 as described above, since lines for connecting the scan driver 210 and the scan driver 210 may be omitted, the complexity of a line structure of the display module 10 or the display apparatus 1 may be reduced, and accordingly, a volume of the display module 10 or the display apparatus 1 may also be reduced, so that a bezel-less screen may be implemented by reducing a side surface line region.

The timing control signal output from the timing controller 500 may be input to the gate signal generator 131G of the micro pixel controller 130, and the gate signal generator 131G may generate a gate signal for turning a switching transistor $TR_1$ of a pixel circuit 131P on/off based on the input timing control signal.

The micro pixel controller 130 may include the pixel circuit 131P for individually controlling each inorganic light-emitting element 120, and the gate signal output from the scan driver 210 or the gate signal generator 131G and the data signal output from the data driver 220 may be input to the pixel circuit 131P.

The gate signal or the data signal may be transmitted to adjacent micro pixel controller 130. For example, the gate signal may be sequentially transmitted to the micro pixel controllers 130 adjacent to each other in a row direction, and the data signal may be sequentially transmitted to the micro pixel controllers 130 adjacent to each other in a column direction. As described above, since signals are sequentially transmitted between the micro pixel controllers 130, the line structure may be simplified.

When a gate voltage $V_{GATE}$, a data voltage $V_{DATA}$, and a power supply voltage $V_{DD}$ are input to the pixel circuit 131P, the pixel circuit 131P may output a driving current $I_D$ for driving the inorganic light-emitting element 120.

The driving current $I_D$ output from the pixel circuit 131P may be input to the inorganic light-emitting element 120, and the inorganic light-emitting element 120 may emit light due to the input driving current $I_D$ to implement an image.

The pixel circuit 131P may include thin-film transistors $TR_1$ and $TR_2$ configured to switch or drive the inorganic light-emitting element 120 and a capacitor $C_{st}$. As described above, the inorganic light-emitting element 120 may be a micro-LED.

For example, the thin-film transistors $TR_1$ and $TR_2$ may include the switching transistor $TR_1$ and a driving transistor $TR_2$, and the switching transistor $TR_1$ and the driving transistor $TR_2$ may be implemented as P-type metal oxide semiconductor (PMOS) type transistors. However, the embodiment of the display module 10 and the display apparatus 1 is not limited thereto, and the switching transistor $TR_1$ and the driving transistor $TR_2$ may be implemented as N-type metal oxide semiconductor (NMOS) type transistors.

The switching transistor $TR_1$ has a gate electrode to which the gate voltage $V_{GATE}$ is input, a source electrode to which the data voltage $V_{DATA}$ is input, and a drain electrode that is connected to one end of the capacitor $C_{st}$ and a gate electrode of the driving transistor $TR_2$.

In addition, the driving transistor $TR_2$ has a source electrode to which the power supply voltage $V_{DD}$ is applied and a drain electrode that is connected to an anode of the inorganic light-emitting element 120. A reference voltage $V_{SS}$ may be applied to a cathode of the inorganic light-emitting element 120. The reference voltage $V_{SS}$ may be a voltage lower than the power supply voltage $V_{DD}$, and a ground voltage or the like may be used as the reference voltage $V_{SS}$ to provide the ground.

The pixel circuit 131P of the above-described structure may operate as described below. First, when the gate voltage $V_{GATE}$ is applied and the switching transistor $TR_1$ is turned on, the data voltage $V_{DATA}$ may be transmitted to one end of the capacitor $C_{st}$ and the gate electrode of the driving transistor $TR_2$.

A voltage corresponding to a gate-source voltage VGS of the driving transistor $TR_2$ may be maintained for a predetermined time due to the capacitor $C_{st}$. The driving transistor $TR_2$ may apply the driving current $I_D$ corresponding to the gate-source voltage VGS to the anode of the inorganic light-emitting element 120, thereby causing the inorganic light-emitting element 120 to emit light.

The brightness of the inorganic light-emitting element 120 may vary depending on a magnitude of the driving current (i.e., an amplitude of the driving current) and the brightness may be differently expressed according to an emission duration of the inorganic light-emitting element 120 even when a driving current of the same magnitude is applied.

The display module 10 according to one embodiment may control the inorganic light-emitting element 120 by combining pulse amplitude modulation (PAM) control for controlling the amplitude of the driving current and pulse width modulation (PWM) control for controlling a pulse width of the driving current.

Figure 9:
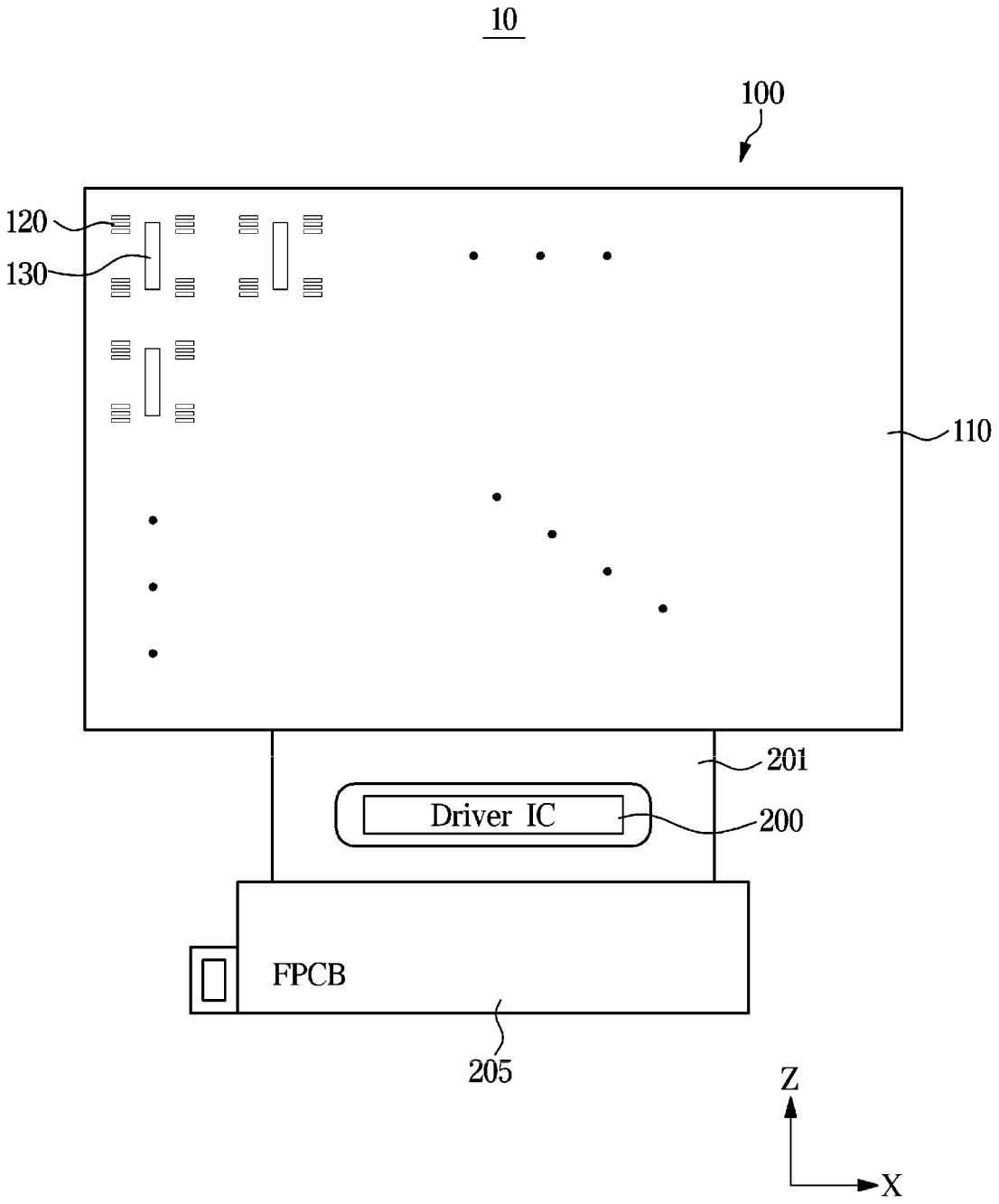
FIG. 9 is a diagram illustrating an example of a method of electrically connecting a display panel and a driver integrated circuit (IC) in the display module according to an embodiment.

FIG. 9 is a diagram illustrating an example of a method of electrically connecting the display panel and the driver IC in the display module according to an embodiment.

The driver IC 200 may be electrically connected to the display panel 100 by employing one of various bonding methods such as chip-on-film (COF) or film-on-glass (FOG) bonding, chip-on-glass (COG) bonding, and tape-automated bonding (TAB).

For example, when the COF bonding is employed, as shown in FIG. 9, the driver IC 200 is mounted on a film 201, and one end of the film 201 on which the driver IC 200 is mounted may be electrically connected to the module substrate 110 and the other end thereof may be electrically connected to a flexible printed circuit board (FPCB) 205.

The signal supplied from the driver IC 200 may be transmitted to the micro pixel controller 130 through a side surface line or a via hole line formed on the module substrate 110.

Figure 10:
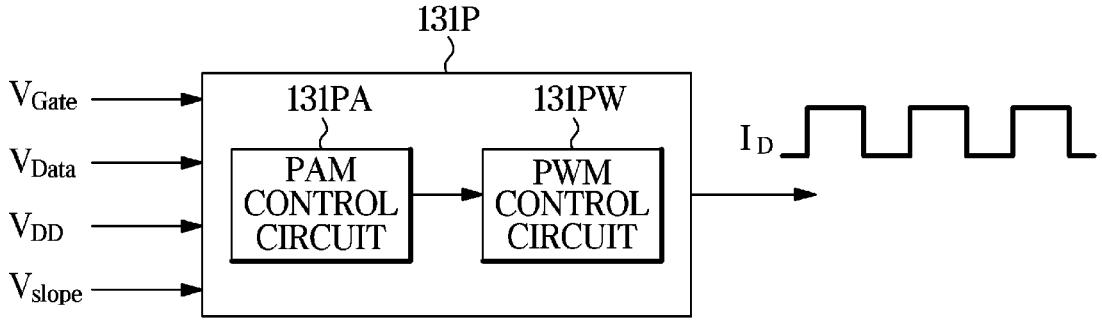
FIGS. 10 and 11 are diagrams illustrating a configuration of the micro pixel controller in the display module according to an embodiment.
Figure 11:
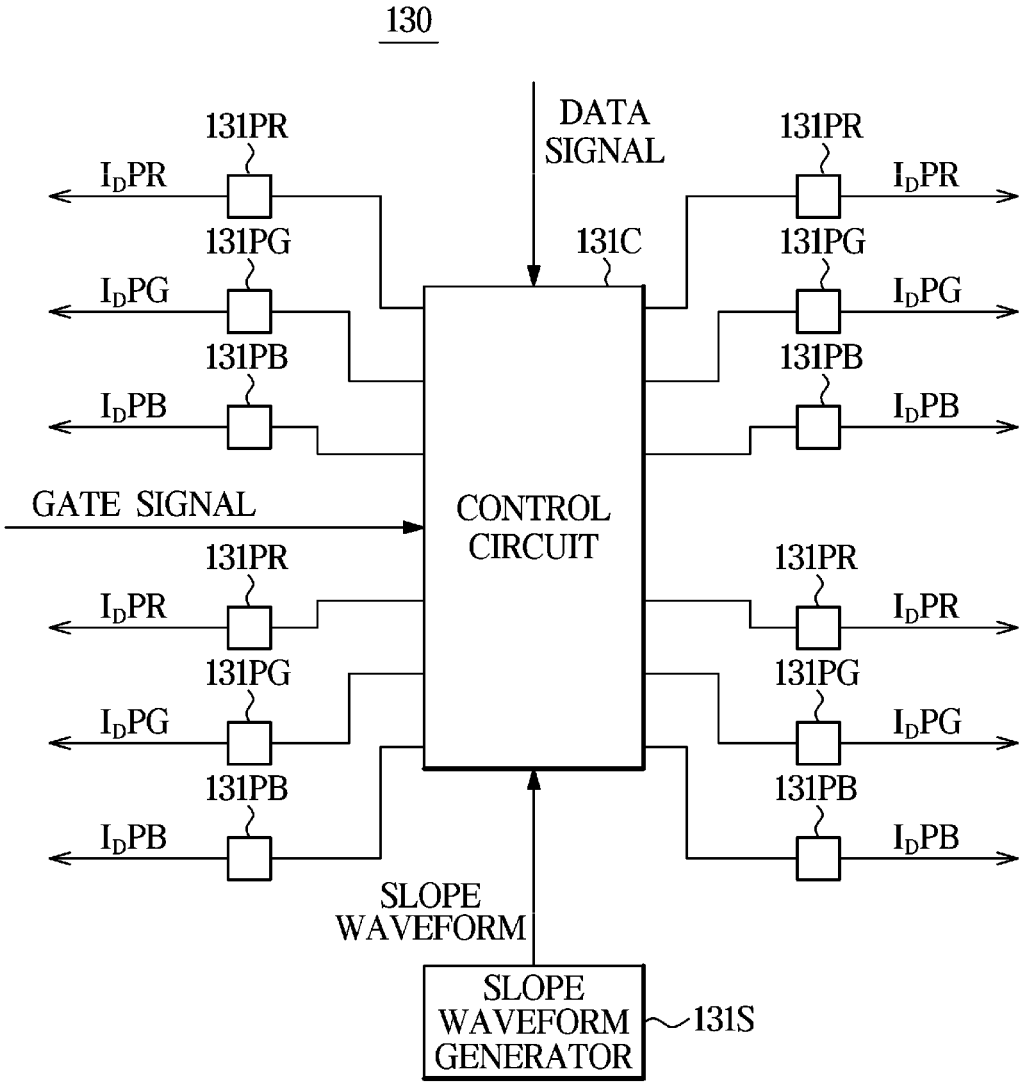

FIGS. 10 and 11 are diagrams illustrating a configuration of the micro pixel controller in the display module according to an embodiment.

Referring to FIG. 10, each of the plurality of pixel circuits 131P included in the micro pixel controller 130 may include a PAM control circuit 131PA for controlling the amplitude of the driving current and a PWM control circuit 131PW for controlling the pulse width of the driving current.

When the gate voltage $V_{GATE}$, the data voltage $V_{DATA}$, the power supply voltage $V_{DD}$, and a slope voltage $V_{slope}$ are input to the pixel circuit 131P including the PAM control circuit 131PA and the PWM control circuit 131PW, a driving current $I_D$ whose amplitude and pulse width are controlled to express a grayscale of the input image may be output.

The PAM control circuit 131PA may include circuit elements such as the above-described thin-film transistors $TR_1$ and $TR_2$ and capacitor $C_{st}$, and the PWM control circuit 131PW may include circuit elements such as a comparator, a capacitor, and the like. Some of the components of the PAM control circuit 131PA may overlap those of the PWM control circuit 131PW, and, in addition to the PAM control circuit 131PA and the PWM control circuit 131PW, other components for controlling an input and output or controlling the transmission of the signal may be further included.

The plurality of pixel circuits 131P may be formed on an IC substrate. The IC substrate may be implemented as one of substrates of various materials such as a silicon substrate, a glass substrate, a plastic substrate, a PCB, an FPCB, and a cavity substrate. Since there is no heat source, such as the inorganic light-emitting element, in the micro pixel controller 130, the type of substrate may be selected without limitation according to the heat resistance of the material.

The thin-film transistor (TFT) formed on the IC substrate may be a low-temperature polycrystalline silicon (LTPS) TFT or an oxide TFT. In addition, the TFT may also be an amorphous silicon (a-Si) TFT or a single crystal TFT.

For example, in the case of the LTPS TFT, electron mobility may vary depending on a material of the substrate on which the TFT is formed. A silicon substrate does not have restrictions on electron mobility as compared with a glass substrate, and thus when the IC substrate is implemented as a silicon substrate, the performance of the LTPS TFT may be improved. In this embodiment, since the inorganic light-emitting element 120, which is a heat source, is transferred to the module substrate 110 rather than the IC substrate, the IC substrate may be implemented as a silicon substrate without limitation due to heat resistance.

Further, the module substrate 110 to which the inorganic light-emitting elements 120 are transferred may also be implemented as one of substrates of various materials such as a silicon substrate, a glass substrate, a plastic substrate, a PCB, an FPCB, and a cavity substrate.

On the module substrate 110, circuit elements such as a TFT other than electrode pads and lines do not have to be formed. Thus, since other restrictions such as TFT performance do not have to be considered in selecting the type of module substrate 110, the module substrate 110 may be implemented as a glass substrate having excellent durability against the heat of the inorganic light-emitting element 120.

Further, since circuit elements such as a TFT are not provided on the module substrate 110, the circuit elements may be prevented from being damaged in a cutting process of the module substrate 110 and a line formation process, or a replacement process of the inorganic light-emitting element 120, and the difficulty of a manufacturing process of the display module 10 may be reduced.

Before transferring the micro pixel controllers 130 to the module substrate 110, circuit inspection may be performed individually for each micro pixel controller 130, and only the micro pixel controller 130 determined as a good product by the circuit inspection may be mounted in the display module 10. Accordingly, in comparison with a case in which a TFT circuit is directly mounted on the module substrate, the circuit may be easily inspected and defective products may be easily replaced.

Referring to FIG. 11, the micro pixel controller 130 may include the above-described pixel circuit 131P, and the pixel circuit 131P may be provided in a number corresponding to the number of the pixels P controlled by the micro pixel controller 130 (i.e., the number of inorganic light-emitting elements 120).

For example, when one micro pixel controller 130 controls the pixels of a 2×2 array, the micro pixel controller 130 may include a pixel circuit 131PR, a pixel circuit 131PG, and a pixel circuit 131PB for respectively driving a red inorganic light-emitting element 120R, a green inorganic light-emitting element 120G, and a blue inorganic light-emitting element 120B that are included in each of the four pixels.

A driving current $I_D$PR output from the red pixel circuit 131PR may be input to the red inorganic light-emitting element 120R, a driving current $I_D$PG output from the green pixel circuit 131PG may be input to the green inorganic light-emitting element 120G, and a driving current $I_D$PB output from the blue pixel circuit 131PB may be input to the blue inorganic light-emitting element 120B.

Further, the micro pixel controller 130 may further include a control circuit 131C for distributing an input signal to each pixel circuit 131E When the gate signal and the data signal are input, the control circuit 131C may distribute the input gate signal and data signal to each pixel circuit 131P according to a control logic. To this end, the control circuit 131C may include a multiplexer or demultiplexer, and the control logic may be determined by the timing control signal.

As described above, the display module 10 according to one embodiment may apply PWM control in controlling the brightness of the inorganic light-emitting element 120 and may use a slope waveform for the PWM control.

When the slope waveform input to the pixel circuit 131P is generated in a circuit outside the display panel 100, such as the timing controller 500, and transmitted, an infrared (IR) drop or a time delay may occur due to a line resistance while the slope waveform is being transmitted. Accordingly, a variation may occur in the input slope waveform according to a location of the inorganic light-emitting element 120 or a location of the micro pixel controller 130, and thus, it may be difficult to accurately control the brightness, and a variation in image quality may occur according to a location in a screen.

In particular, when the plurality of display modules 10 are combined to implement the display apparatus 1 of a large-area screen, depending on a location of the display module 10, and a location of the inorganic light-emitting element 120 in the display module 10, the variation in the arriving slope waveform may become greater.

In addition, when the number of functions performed outside the display panel 100 increases, or another circuit layer is formed on the module substrate 110 to perform a function, the line, structure, and manufacturing process of the display module 10 are complicated, the display module 10 may be bulky, and there are more restrictions on selecting a substrate.

Accordingly, the display module 10 according to one embodiment may generate the slope waveform used for the PWM control by itself in the micro pixel controller 130. As a result, by inputting the slope waveform of the same shape to each pixel at a correct timing, the same image quality may be implemented regardless of the location of the inorganic light-emitting element 120, and lines connected to the outside may be reduced.

Further, by generating the slope waveform individually for each micro pixel controller 130, the occurrence of noise or distortion due to element characteristics may be reduced.

To this end, as shown in FIG. 11, the micro pixel controller 130 may include a slope waveform generator 131S configured to generate the slope waveform. The slope waveform output from the slope waveform generator 131S may be input to the control circuit 131C, and the control circuit 131C may distribute the slope waveform to the plurality of pixel circuits 131P according to the control logic. Alternatively, the slope waveform generated by the slope waveform generator 131S may be directly input to the plurality of pixel circuits 131P.

The display module 10 according to one embodiment may include the slope waveform generator 131S for each micro pixel controller 130. Alternatively, a plurality of micro pixel controllers may be grouped and one micro pixel controller 130 may generate the slope waveform for each group and transmit the generated slope waveform to the remaining micro pixel controllers belonging to the same group.

Figure 12:
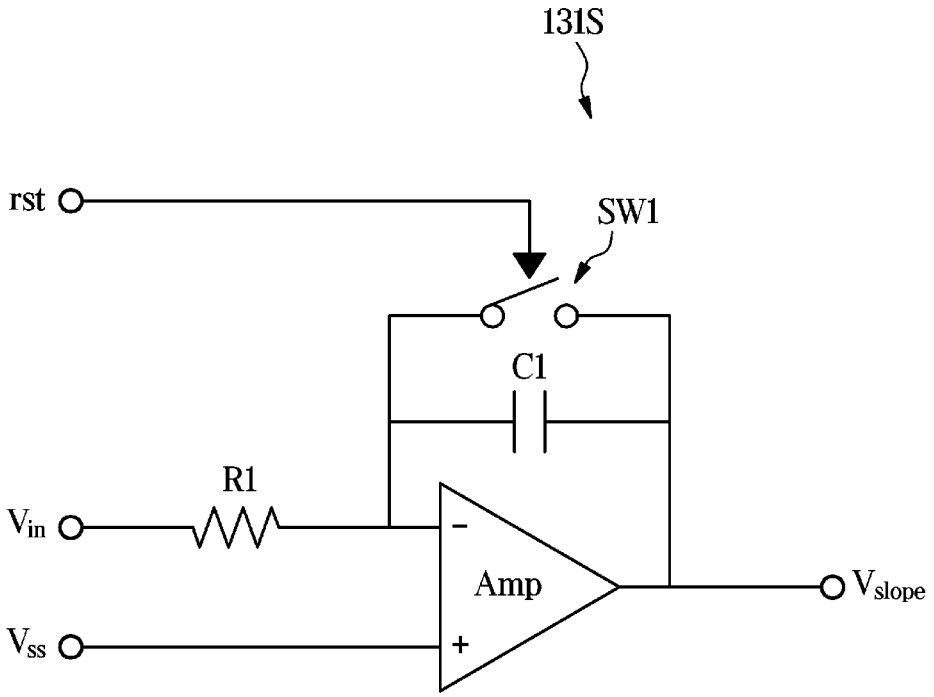
FIG. 12 is a diagram illustrating a circuit structure of a slope waveform generator included in the micro pixel controller in the display module according to an embodiment.
Figure 13:
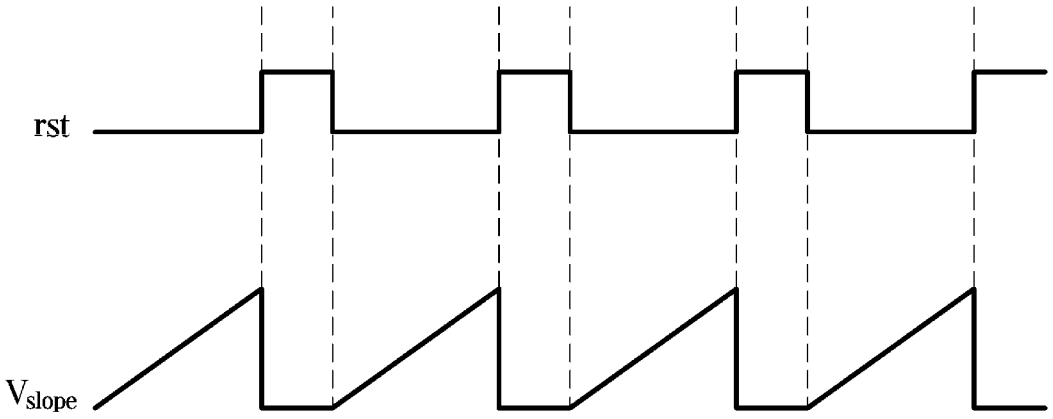
FIG. 13 is a graph illustrating an example of a slope waveform output from the slope waveform generator included in the micro pixel controller in the display module according to an embodiment.

FIG. 12 is a diagram schematically illustrating a circuit structure of the slope waveform generator included in the micro pixel controller in the display module according to an embodiment, and FIG. 13 is a graph illustrating an example of the slope waveform output from the slope waveform generator included in the micro pixel controller in the display module according to an embodiment. FIGS. 14 to 19 are diagrams illustrating examples of a circuit structure applicable to the slope waveform generator in the display module according to an embodiment.

As an example, the slope waveform generator 131S may generate the slope waveform using an integrator based on an operational amplifier (Op Amp) Referring to the example of FIG. 12, the slope waveform generator 131S may include an integrator including an operational amplifier Amp, a capacitor C1, and a resistor R1, and the power supply voltage $V_{DD}$ may be an input voltage $V_{in}$.

Referring to FIG. 13, when a switch SW1 is connected to the integrator and the switch SW1 is turned on/off in response to a reset signal rst, a sawtooth-shaped slope waveform $V_{slope}$ may be output. The slope waveform $V_{slope}$ may be referred to as a sawtooth waveform and may also be referred to as a sweep waveform, and as long as a waveform has a form of rising with a certain slope and falling, the waveform may be included in a range of the slope waveform $V_{slope}$ in this embodiment regardless of the name of the waveform.

Figure 14:
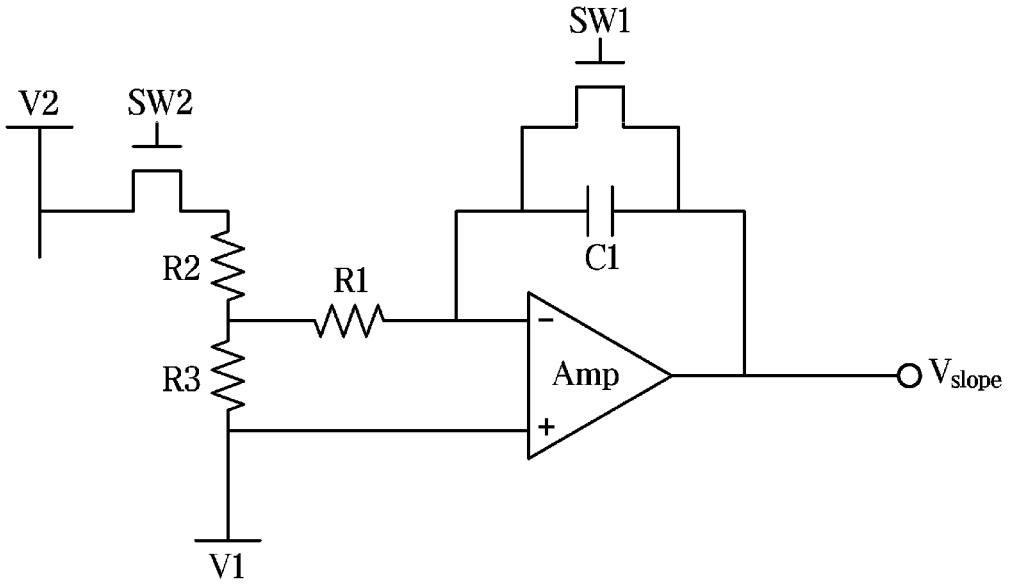
FIGS. 14, 15, 16, 17, 18, and 19 are diagrams illustrating examples of a circuit structure applicable to the slope waveform generator in the display module according to an embodiment.
Figure 15:
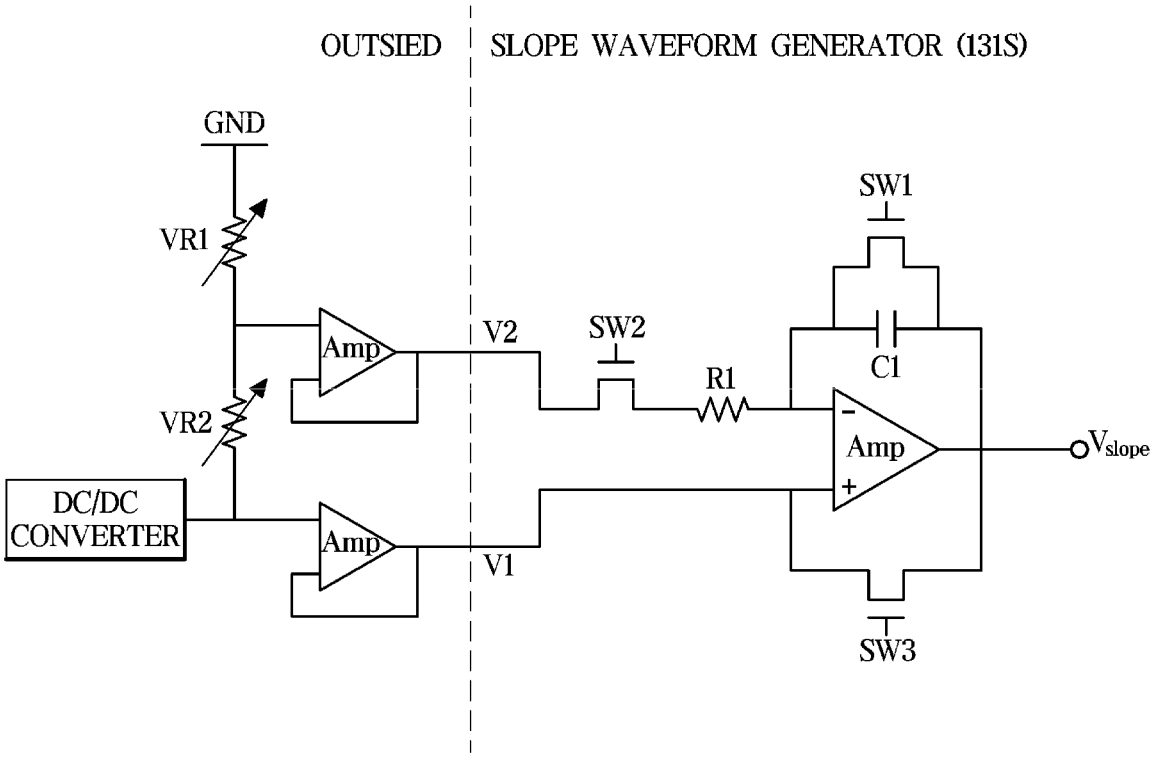

The slope waveform generator 131S may be implemented by various circuit structures based on an integrator. As shown in FIG. 14, the slope waveform may be gradually increased by dividing reference voltages V1 and V2 using internal resistors R2 and R3, and as shown in FIG. 15, the slope waveform may also be gradually increased by inputting the reference voltages V1 and V2, which are divided using variable resistors VR1 and VR2 outside the slope waveform generator 131S, to the integrator.

Figure 16:
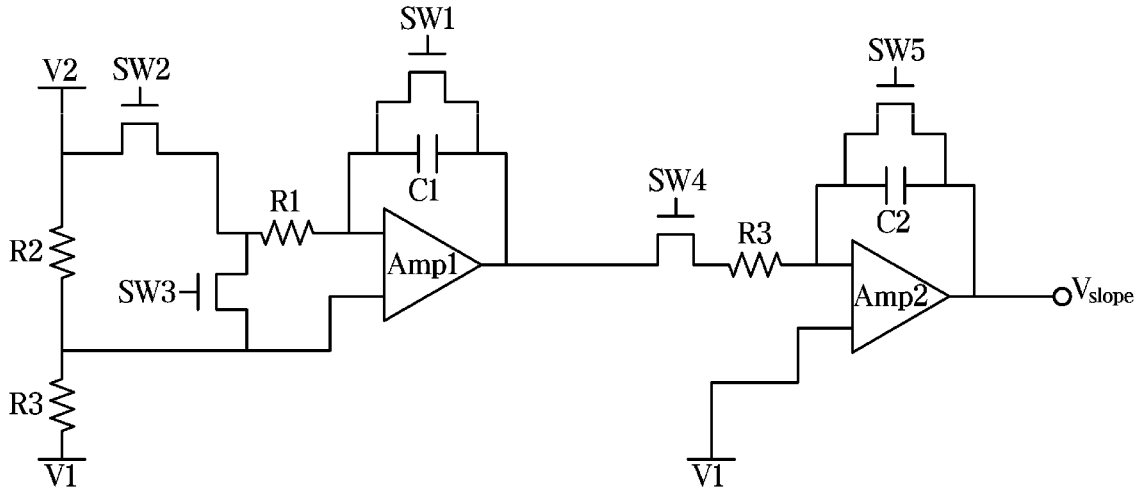
Figure 17:
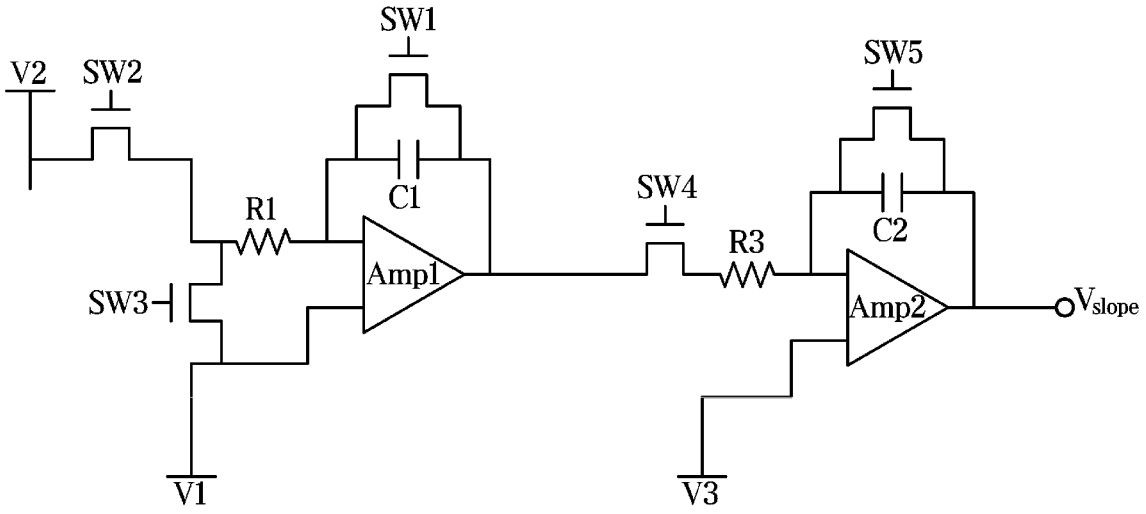

Alternatively, as shown in FIGS. 16 and 17, a Resistor-Capacitor (RC) dispersion may be offset by implementing integrators with resistors R1.

Figure 18:
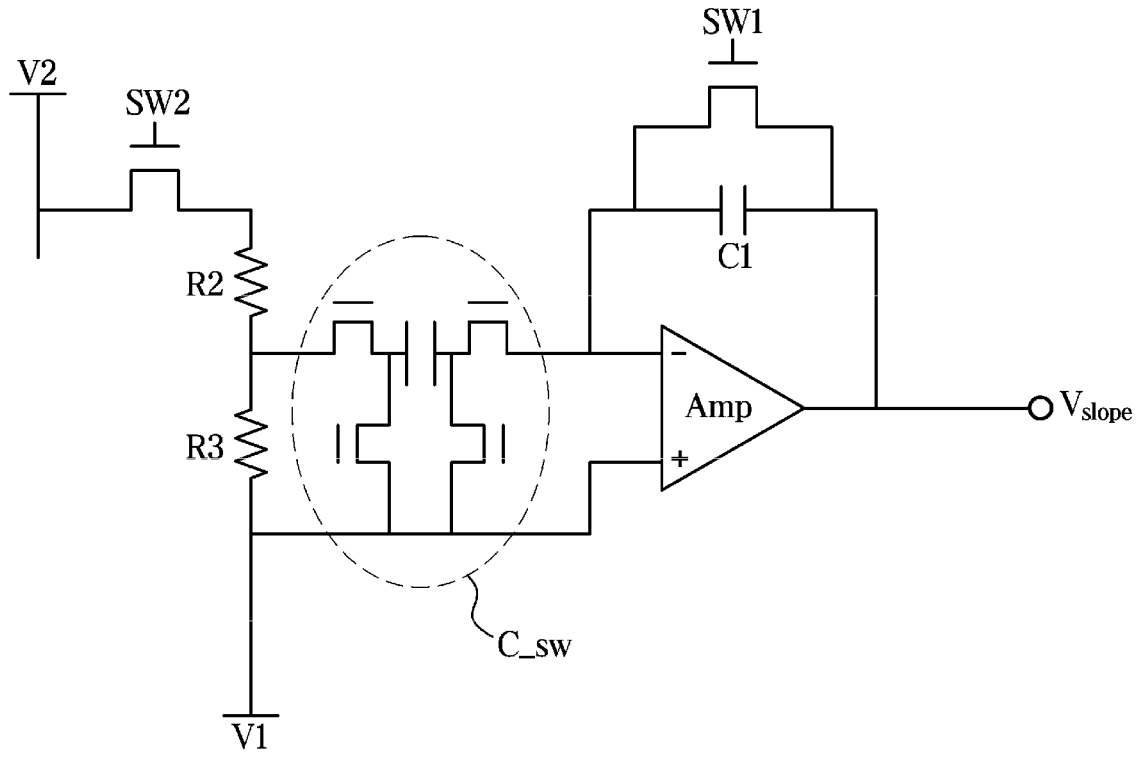
Figure 19:
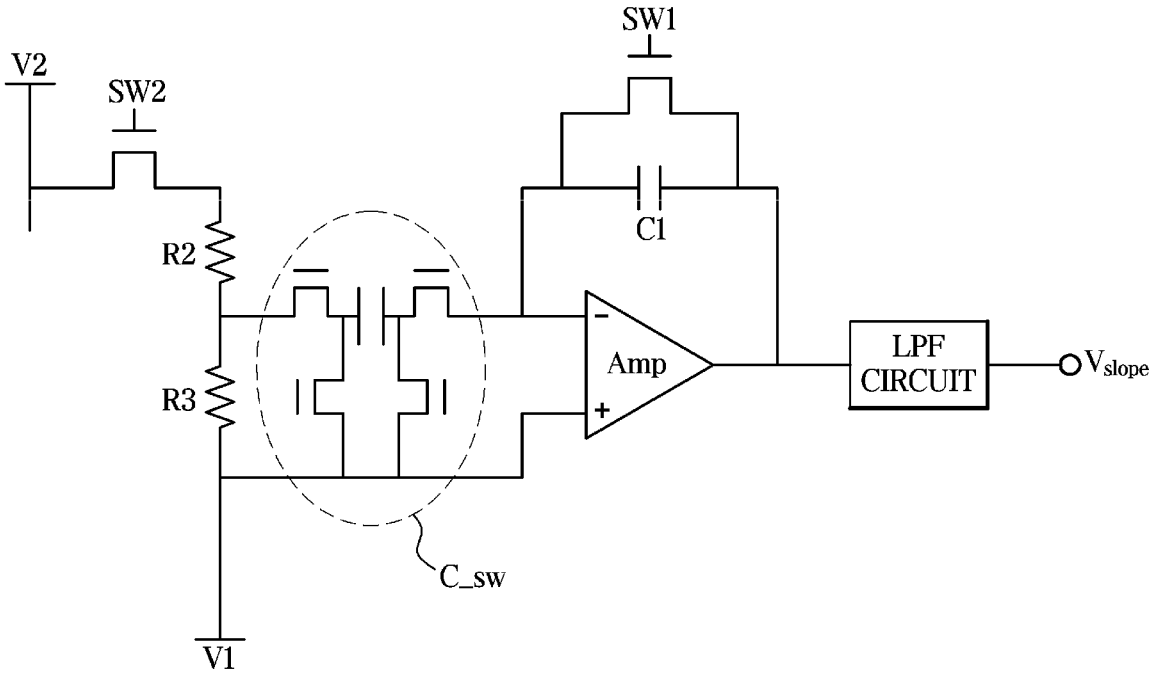

Alternatively, as shown in FIG. 18, an integrator may be implemented by connecting a switched capacitor $C_{_SW}$ instead of the resistor R1 to input terminals of the integrator, and as shown in FIG. 19, a low-pass-filter (LPF) circuit may be additionally connected to an output terminal of the integrator.

Figure 20:
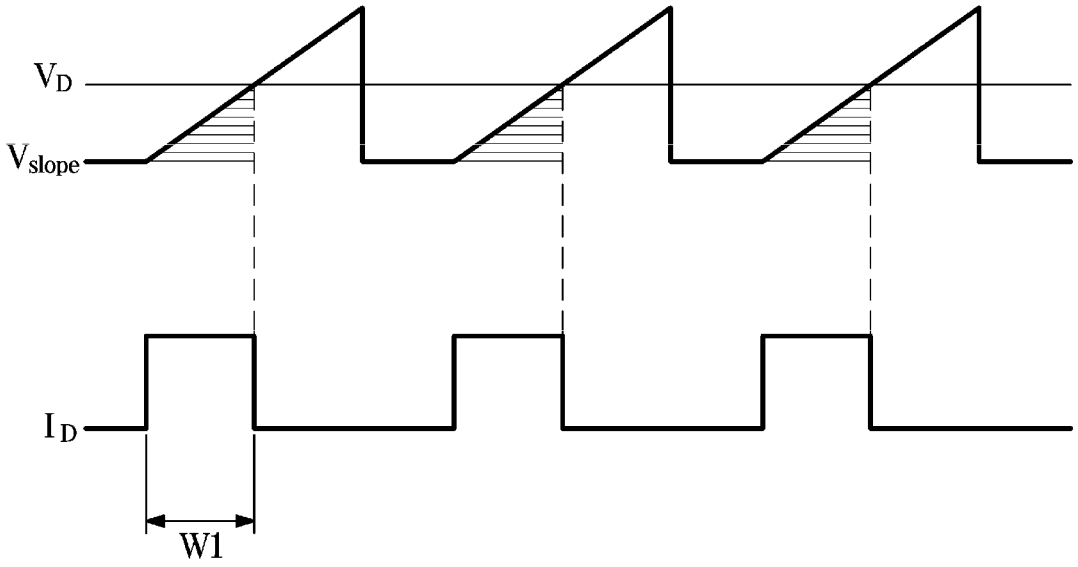
FIGS. 20 and 21 are graphs illustrating examples of an output waveform according to an input in a pulse width modulation (PWM) control circuit in the display module according to an embodiment.
Figure 21:
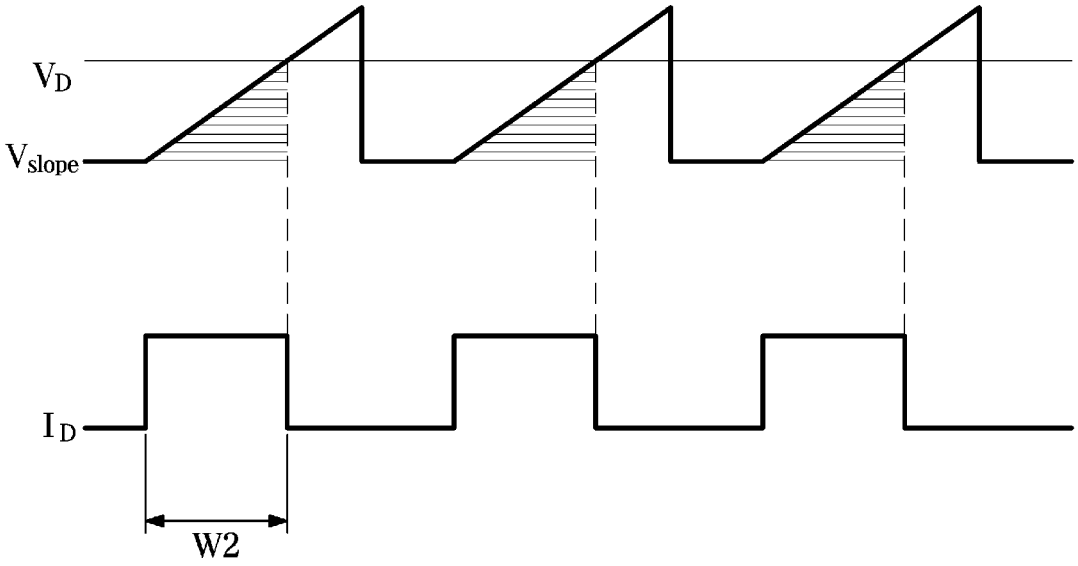

FIGS. 20 and 21 are graphs illustrating examples of an output waveform according to an input in the PWM control circuit in the display module according to an embodiment.

A driving voltage $V_D$ corresponding to the driving current $I_D$ output from the PAM control circuit 131PA and the slope waveform $V_{slope}$ output from the slope waveform generator 131S may be input to the PWM control circuit 131PW.

The PWM control circuit 131PW may include a comparator. The PWM control circuit 131PW may compare the driving voltage $V_D$ and the slope waveform $V_{slope}$, and as shown in FIGS. 20 and 21, when the driving voltage is greater than the slope waveform ($V_D > V_{slope}$), the driving current ID may be supplied to the inorganic light-emitting element 120, and when the driving voltage is less than or equal to the slope waveform ($V_D <= V_{slope}$), the supply of the driving current ID may be stopped.

According to the above-described control, as the driving voltage $V_D$ increases, a pulse width may be increased (W1<W2), and thus the pixel circuit 131P may control the brightness of the inorganic light-emitting element 120 by adjusting both the amplitude and pulse width of the driving current ID in this way. As a result, the display module 10 may express various grayscales as compared with a case in which only the amplitude is adjusted or only the pulse width is adjusted.

Figure 22:
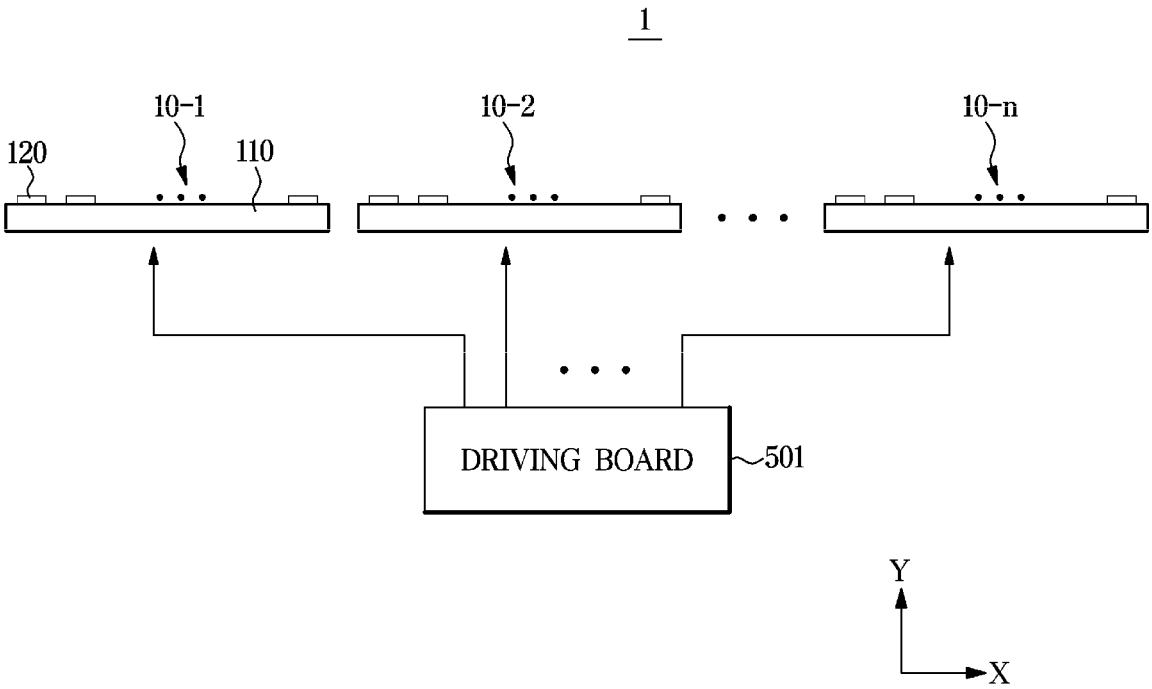
FIGS. 22 and 23 are diagrams illustrating examples in which a signal is transmitted to a plurality of tiled display modules in the display apparatus according to an embodiment.
Figure 23:
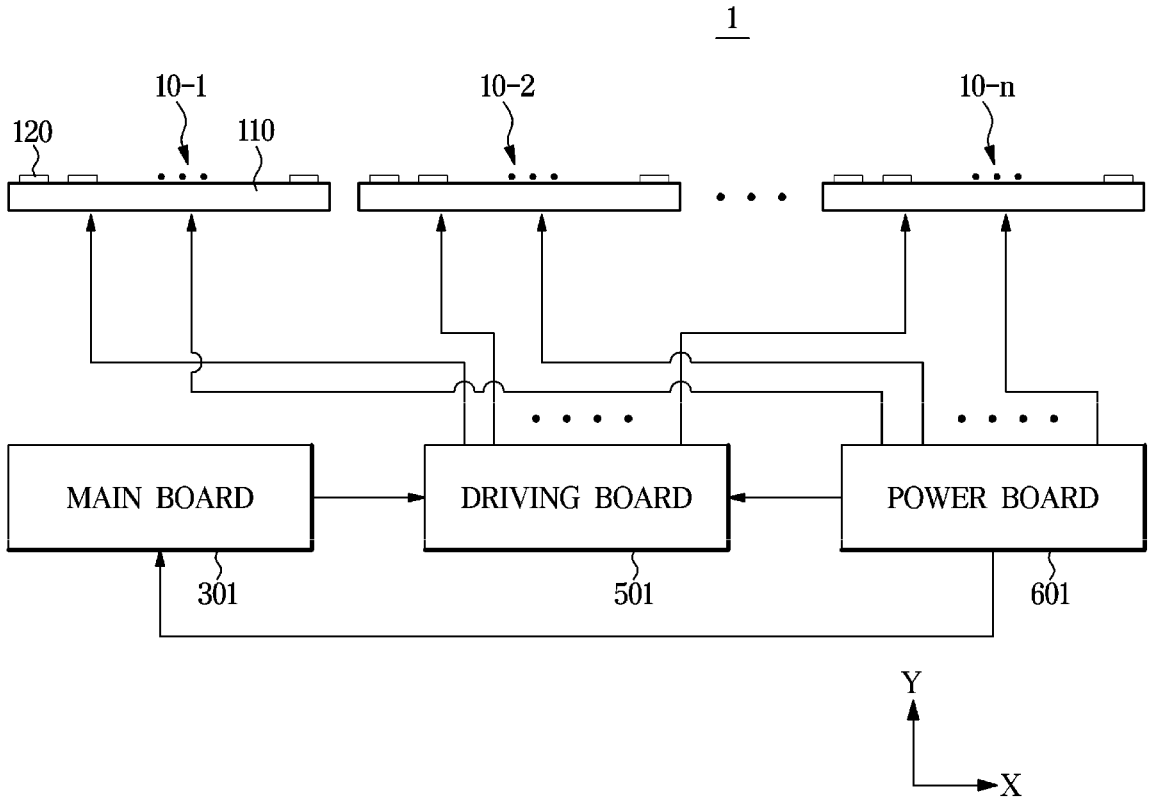

FIGS. 22 and 23 are diagrams illustrating examples in which a signal is transmitted to a plurality of tiled display modules in the display apparatus according to an embodiment.

As described above, the display apparatus 1 having a large-area screen may be implemented by tiling the plurality of display modules 10-1, 10-2, . . . , and **10-*n*. FIGS. 22 and 23 are diagrams illustrating the display apparatus 1 on an XY plane and thus illustrate only one-dimensional arrangement of the display modules 10-1, 10-2, . . . , and 10-*n*. However, the plurality of display modules 10-1, 10-2, . . . , and 10-*n* may also be arranged two dimensionally as described above with reference to FIG. 1**.

As described above, the display panel 100 may be connected to the FPCB 205 through the film 201 on which the driver IC 200 is mounted. The FPCB 205 may be connected to a driving board 501 to electrically connect the display module 10 to the driving board 501.

The timing controller 500 may be provided on the driving board 501. Accordingly, the driving board 501 may be referred to as a T-con board. The plurality of display modules 10-1, 10-2, . . . , and **10-*n* may receive image data, a timing control signal, and the like from the driving board 501**.

Referring to FIG. 23, the display apparatus 1 may further include a main board 301 and a power board 601. The above-described main controller 300 may be provided on the main board 301, and a power supply circuit may be provided on the power board 601 to supply power to the plurality of display modules 10-1, 10-2, . . . , and **10-*n***.

The power board 601 may be electrically connected to the plurality of display modules 10-1, 10-2, . . . , and **10-*n* through the FPCB, and may supply the power supply voltage $V_{DD}$, the reference voltage $V_{SS}$, and the like to the plurality of display modules 10-1, 10-2, . . . , and 10-*n*** that are connected through the FPCB.

For example, the power supply voltage $V_{DD}$ supplied from the power board 601 may be applied to the micro pixel controller 130 through a side surface line or a via hole line formed on the module substrate 110. The reference voltage $V_{SS}$ supplied from the power board 601 may be applied to the micro pixel controller 130 or the inorganic light-emitting element 120 through the side surface line and the via hole line formed on the module substrate 110.

In the above-described example, the plurality of display modules 10-1, 10-2, . . . , and **10-*n* are described as sharing the driving board 501, but it is also possible that a separate driving board 501 is connected to each individual display module. Alternatively, the plurality of display modules 10-1, 10-2, . . . , and 10-*n* may be grouped, and one driving board 501** may be connected to each group.

Figure 24:
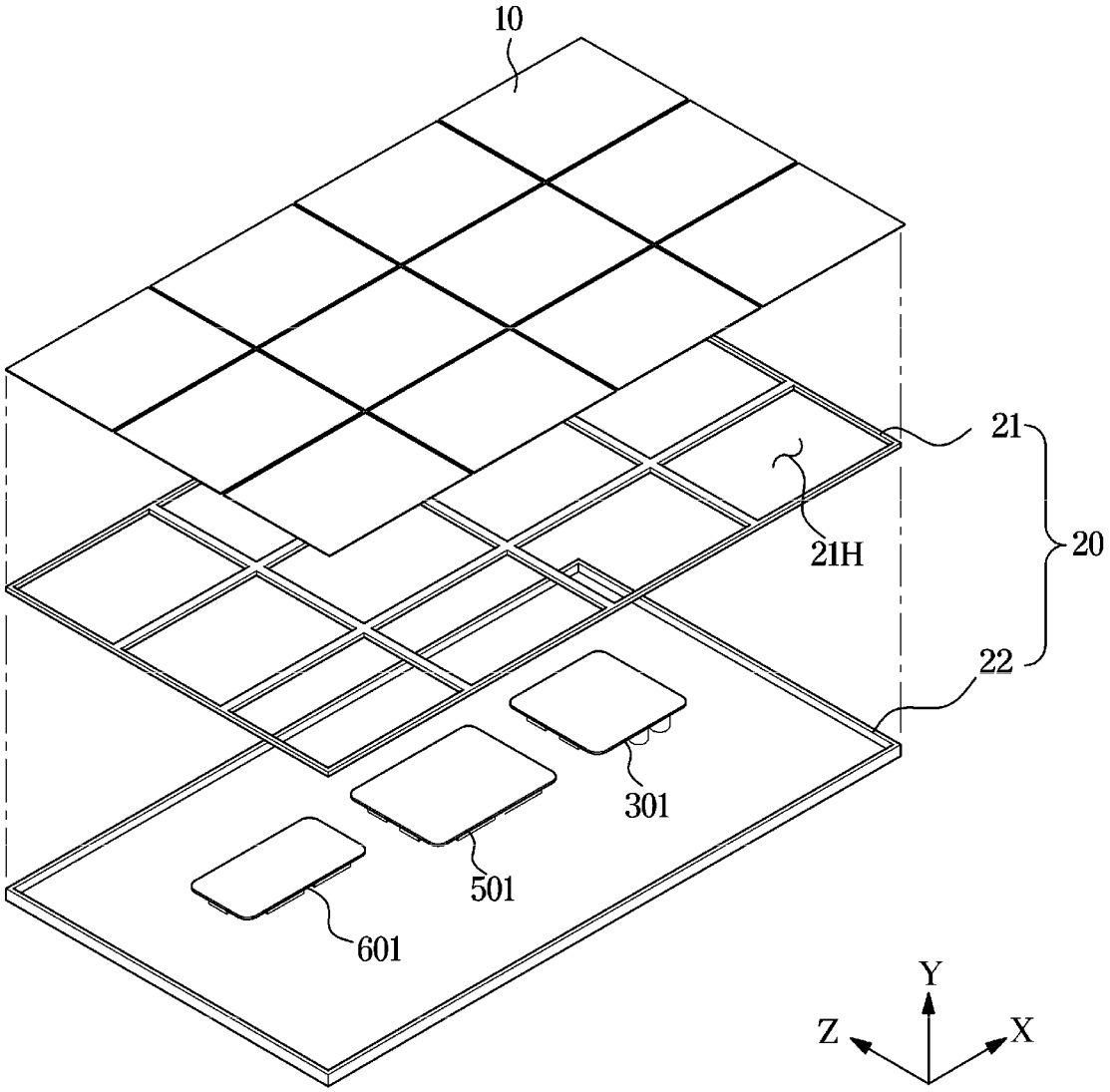
FIG. 24 is a diagram illustrating an example of a method in which the plurality of display modules are coupled to a housing in the display apparatus according to an embodiment.

FIG. 24 is a diagram illustrating an example of a method in which the plurality of display modules are coupled to the housing in the display apparatus according to an embodiment.

As described above, the plurality of display modules 10 may be arranged in the form of a two-dimensional matrix and fixed to the housing 20. Referring to the example of FIG. 24, the plurality of display modules 10 may be installed in a frame 21 located therebelow, and the frame 21 may have a two-dimensional mesh structure having an open partial region corresponding to the plurality of display modules 10.

As many openings 21H as the number of the display modules 10 may be formed in the frame 21, and the openings 21H may have the same arrangement as the plurality of display modules 10.

An edge region of a lower surface of each of the plurality of display modules 10 may be mounted on the frame 21. The edge region of the lower surface may be a region in which a circuit element or line is not formed.

The plurality of display modules 10 may be mounted on the frame 21 through a method of using magnetic force due to a magnet, coupling by a mechanical structure, bonding by an adhesive, or the like. There is no limitation on the method in which the display module 10 is mounted on the frame 21.

The driving board 501, the main board 301, and the power board 601 may be disposed below the frame 21, and may be electrically connected to each of the plurality of display modules 10 through the openings 21H formed in the frame 21.

A lower cover 22 is coupled to a lower portion of the frame 21, and the lower cover 22 may form a lower exterior of the display apparatus 1.

In the above-described example, the case in which the display modules 10 are arranged two dimensionally was taken as an example, however, the display modules 10 may be arranged in one dimension, and in this case, the structure of the frame 21 may also be transformed into a one-dimensional mesh structure.

Further, the above-described shape of the frame 21 is merely an example applicable to the embodiment of the display apparatus, and the display modules 10 may be fixed by applying various shapes of frames.

Figure 25:
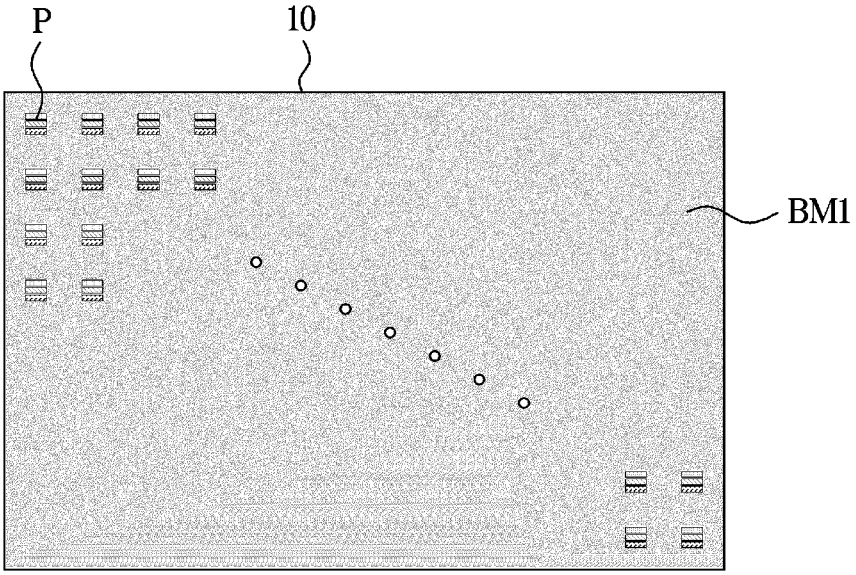
FIG. 25 is a diagram illustrating an example of black matrix (BM) processing performed on the display module according to an embodiment.
Figure 26:
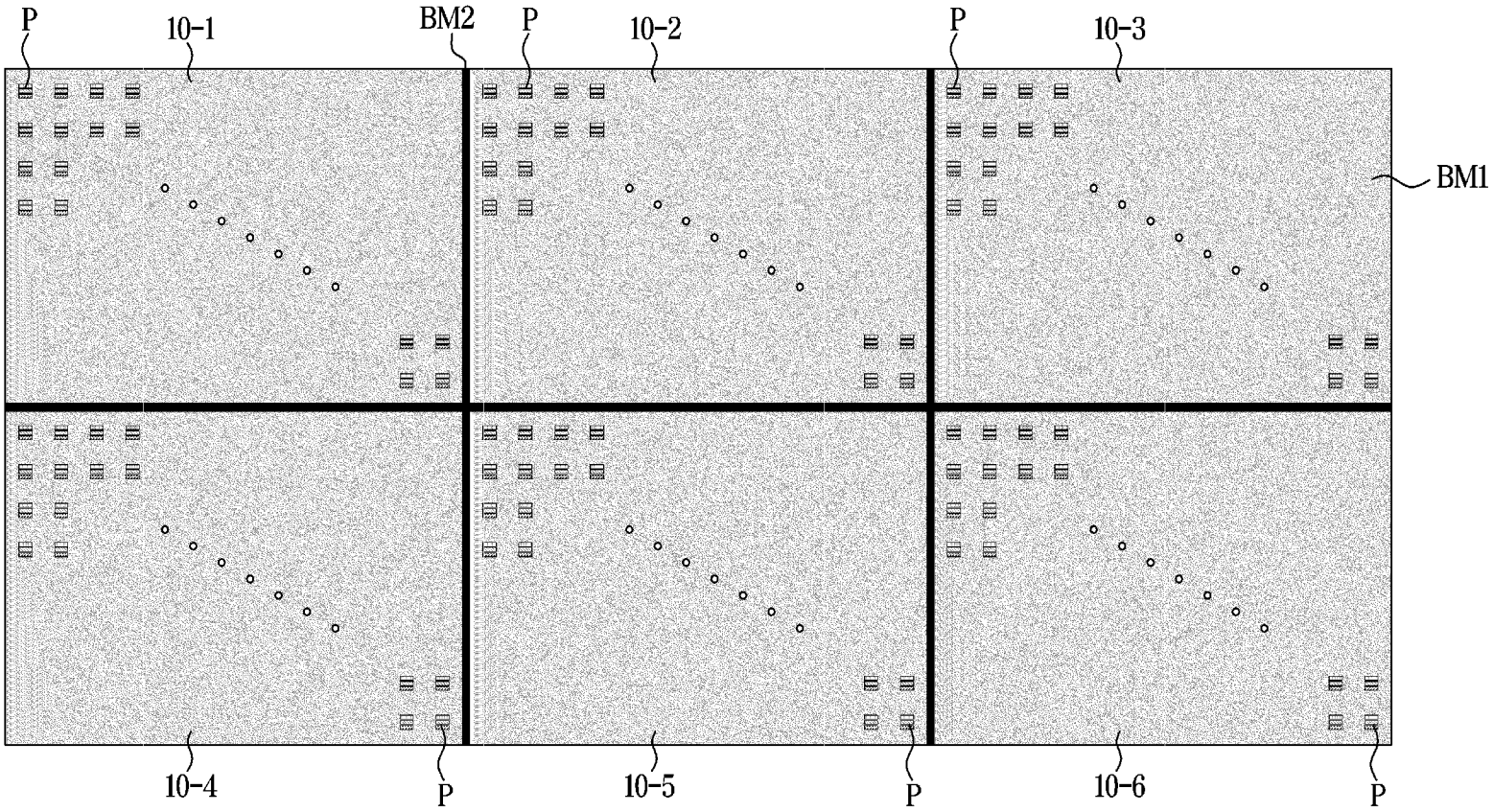
FIG. 26 is a diagram illustrating an example of BM processing performed on the display apparatus according to an embodiment.

FIG. 25 is a diagram illustrating an example of black matrix (BM) processing performed on the display module according to an embodiment, and FIG. 26 is a diagram illustrating an example of BM processing performed on the display apparatus according to an embodiment.

Referring to FIG. 25, in order to block unnecessary light except for light required for implementing an image, to prevent the light from being diffused in a gap between the pixels, and to improve contrast, BM processing may be performed on the display module 10.

For example, a black matrix layer BM1 may be formed on the upper surface of the module substrate 110 by applying one of various BM processing methods such as printing a black ink on the upper surface of the module substrate 110, performing a patterning process using a black photosensitive material, or using a black anisotropic conductive film (ACF) when the inorganic light-emitting element 120 is mounted on the module substrate 110. At this point, the black matrix layer BM1 may also be formed on an upper surface of the micro pixel controller 130 so that it is possible to prevent the micro pixel controller 130 from being visible or to prevent light from being diffusely reflected.

Referring to FIG. 26, in the case in which the display apparatus 1 is implemented by tiling the plurality of display modules 10-1 to 10-6, the BM processing may also be performed on a space between the display modules. As an example, a side surface member BM2 with a material that absorbs light may be formed on side surfaces of each of a plurality of display modules 10-1 to 10-6, particularly, on the side surfaces adjacent to other display modules, so that it is possible to prevent diffuse reflection of light in the gap between the modules and to implement a seamless effect.

The above detailed description exemplifies the present invention. Further, the above-described contents are intended to show and describe exemplary embodiments of the present invention, and the present invention may be used in various other combinations, modifications, and environments. That is, the scope of the inventive concept disclosed in the present specification may be changed or modified within the scope equivalent to the disclosed contents and/or within the skill or knowledge of the related art. The above-described embodiments illustrate the best mode for implementing the technical spirit of the present invention, and various modifications required for specific applications and uses of the present invention are also possible. Accordingly, the above detailed description of the present invention is not intended to limit the present invention to the disclosed embodiments. Further, the appended claims should be construed to include other embodiments.

What is claimed is:

1. A display module comprising:

a module substrate;

a plurality of pixels provided on an upper surface of the module substrate; and a plurality of micro pixel controllers, each of the plurality of micro pixel controllers being configured to control at least two pixels among the plurality of pixels and being provided in a space between the at least two pixels on the upper surface of the module substrate, wherein at least one of the plurality of micro pixel controllers comprises a slope waveform generator configured to control a brightness of each of the at least two pixels by:

generating a slope waveform; and inputting the generated slope waveform to each of the at least two pixels.

2. The display module of claim 1, wherein each of the plurality of micro pixel controllers comprises at least two pixel circuits configured to output driving currents to be applied to the at least two pixels, and wherein the slope waveform generated by the slope waveform generator is input to each of the at least two pixel circuits.

3. The display module of claim 2, wherein each of the at least two pixel circuits comprises:

a pulse amplitude modulation (PAM) control circuit configured to control an amplitude of a driving current applied to one of the at least two pixels; and a pulse width modulation (PWM) control circuit configured to control a pulse width of the driving current based on the input slope waveform.

4. The display module of claim 3, wherein a slope voltage output from the slope waveform generator is input to the PWM control circuit.

5. The display module of claim 1, further comprising a driver integrated circuit (IC) electrically connected to the module substrate and configured to transmit at least one of a data signal and a gate signal to the plurality of micro pixel controllers.

6. The display module of claim 5, wherein the driver IC receives image data and a timing control signal output from a timing controller.

7. The display module of claim 5, wherein the driver IC comprises a data driver IC configured to generate the data signal, and wherein at least one of the plurality of micro pixel controllers is configured to generate the gate signal.

8. A display apparatus comprising:

a housing; and a plurality of display modules mounted in the housing, wherein each of the plurality of display modules comprises:

a module substrate, a plurality of pixels arranged provided on an upper surface of the module substrate, and a plurality of micro pixel controllers, each of the plurality of micro pixel controllers being configured to control at least two pixels among the plurality of pixels and being provided in a space between the at least two pixels on the upper surface of the module substrate, wherein at least one of the plurality of micro pixel controllers comprises a slope waveform generator configured to control a brightness of each of the at least two pixels by:

generating a slope waveform; and inputting the generated slope waveform to each of the at least two pixels.

9. The display apparatus of claim 8, wherein each of the plurality of micro pixel controllers comprises at least two pixel circuits configured to output driving currents to be applied to the at least two pixels, and wherein the slope waveform generated by the slope waveform generator is input to each of the at least two pixel circuits.

10. The display apparatus of claim 9, wherein each of the at least two pixel circuits comprises:

a pulse amplitude modulation (PAM) control circuit configured to control an amplitude of a driving current applied to one of the at least two pixels; and a pulse width modulation (PWM) control circuit configured to control a pulse width of the driving current based on the input slope waveform.

11. The display apparatus of claim 10, wherein a slope voltage output from the slope waveform generator is input to the PWM control circuit.

12. The display apparatus of claim 8, further comprising a driver integrated circuit (IC) electrically connected to the module substrate and configured to transmit at least one of a data signal and a gate signal to the plurality of micro pixel controllers.

13. The display apparatus of claim 12, further comprising a timing controller configured to transmit image data and a timing control signal to the driver IC.

14. The display apparatus of claim 12, wherein the driver IC comprises a data driver IC configured to generate the data signal, and wherein at least one of the plurality of micro pixel controllers is configured to generate the gate signal.

15. A display apparatus comprising:

a plurality of display modules; and a timing controller configured to transmit image data and a timing control signal to the plurality of display modules, wherein each of the plurality of display modules comprises:

a module substrate, a plurality of inorganic light-emitting elements provided on an upper surface of the module substrate, and a plurality of micro pixel controllers, each of the plurality of micro pixel controllers being configured to control an amplitude and a pulse width of a driving current applied to at least two inorganic light-emitting elements among the plurality of inorganic light-emitting elements and being provided in a space between the at least two inorganic light-emitting elements, wherein at least one of the plurality of micro pixel controllers comprises a slope waveform generator configured to control the pulse width of the driving current by:

generating a slope waveform; and inputting the generated slope waveform to each of the at least two pixels.

16. A method of a display module, the method comprising:

controlling, with a micro pixel controller, two or more pixels arranged on an upper surface of a module substrate of the display module, the micro pixel controller being disposed in a space between the two or more pixels;

generating, with a slope waveform generator of the micro pixel controller, a slope waveform; and controlling, with the micro pixel controller, a brightness of the two or more pixels based on the generated slope waveform by inputting the generated slope waveform to each of the at least two pixels.

17. The method of claim 16, further comprising outputting, with two or more pixel circuits of the micro pixel controller, driving currents to be applied to the two or more pixels.

18. The method of claim 16, further comprising transmitting, with a driver integrated circuit (IC) electrically connected to the module substrate, at least one of a data signal and a gate signal to the micro pixel controller.

19. The method of claim 18, further comprising receiving, with the driver IC, image data and a timing control signal output from a timing controller.

20. The method of claim 18, further comprising generating, with the micro pixel controller, the gate signal.

* * * * *